US007230388B2

(12) United States Patent
Takeuchi

(10) Patent No.: US 7,230,388 B2
(45) Date of Patent: Jun. 12, 2007

(54) LIGHTING OF DISCHARGE LAMP BY FREQUENCY CONTROL

(75) Inventor: Kesatoshi Takeuchi, Shioziri (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 11/218,461

(22) Filed: Sep. 6, 2005

(65) Prior Publication Data

US 2006/0055345 A1 Mar. 16, 2006

(30) Foreign Application Priority Data

Sep. 14, 2004 (JP) ..... 2004-266203

(51) Int. Cl.
*G05F 1/00* (2006.01)

(52) U.S. Cl. ..... 315/194; 315/291; 315/307; 315/244; 315/209 R

(58) Field of Classification Search ..... 315/194, 315/291, 307, 308, 297, 224, 225, 246, 247, 315/209 R
See application file for complete search history.

(56) References Cited

U.S. PATENT DOCUMENTS 5,990,634 A * 11/1999 Brown ..... 315/307
6,072,282 A * 6/2000 Adamson ..... 315/276
6,509,700 B2 * 1/2003 Nakatsuka et al. ..... 315/291
6,696,798 B2 * 2/2004 Nishimoto et al. ..... 315/224
6,979,959 B2 * 12/2005 Henry ..... 315/291

FOREIGN PATENT DOCUMENTS

| | | |
|---|---|---|
| JP | A 05-217682 | 8/1993 |
| JP | A 07-022182 | 1/1995 |
| JP | A 07-169583 | 7/1995 |
| JP | A 09-092483 | 4/1997 |
| JP | A 09-167693 | 6/1997 |
| JP | A 2003-031394 | 1/2003 |
| JP | A 2003-163093 | 6/2003 |
| JP | A 2003-243194 | 8/2003 |
| JP | A 2003-308989 | 10/2003 |
| JP | A 2004-047234 | 2/2004 |

* cited by examiner

*Primary Examiner*—Tuyet Thi Vo
(74) *Attorney, Agent, or Firm*—Oliff & Berridge, PLC

(57) ABSTRACT

A discharge lamp controlling apparatus includes a detector for detecting a discharge condition of a discharge lamp; a frequency changing unit for gradually changing a frequency of a voltage to be applied to the discharge lamp until the discharge condition reaches a predetermined lighting condition; and a voltage controller for controlling the voltage to be applied to the discharge lamp on the basis of the frequency changed by the frequency changing unit.

15 Claims, 19 Drawing Sheets fsc=6.21[kHz]

LIGHTING OF DISCHARGE LAMP BY FREQUENCY CONTROL

CROSS REFERENCE TO RELATED APPLICATIONS

The present application claims the priority based on Japanese Patent Application No. 2004-266203 filed on Sep. 14, 2004, the disclosure of which is hereby incorporated by reference in its entirety.

BACKGROUND OF THE INVENTION

1. Field of the Invention

The present invention relates to a technique for lighting a discharge lamp.

2. Description of the Related Art

FIGS. 19A and 19B illustrate a technique disclosed in Japanese Patent Application Publication H05-217682. FIG. 19A shows a discharge lamp lighting apparatus. The discharge lamp lighting apparatus comprises an AC power supply 1, a primary voltage power supply unit 2, a primary voltage controller 7, a secondary voltage lighting circuit 3, a transformer 4, a discharge lamp 5, a primary current detector 6 and a CPU 8. FIG. 19B shows discharge lamp voltage applied to the discharge lamp 5. As shown in FIG. 19B, a secondary voltage is applied in addition to a primary voltage, which is necessary to maintain lighting, to temporally increase a voltage applied to the discharge lamp 5 in order to turn on the discharge lamp 5. During a stable period after the discharge lamp 5 is lit, the CPU 8 observes increase and decrease in electric current while it carries out control for applying the first voltage having a fixed frequency.

The discharge lamp lighting apparatus disclosed in Japanese Patent Application Publication H05-217682, however, has the following problems. First, applying a high voltage consisting of the primary voltage and the secondary voltage in lighting easily causes increase in radiant noise or error-causing noise. Accordingly, it has been necessary to take measures such as providing a protection countermeasure circuit or controlling software. Further, it is not guaranteed that onetime application of the high voltage turns on the discharge lamp 5, and in some cases, the high voltage consisting of the primary voltage and the secondary voltage should be applied several times. Moreover, a temperature of the discharge lamp 5 just after extinguishing the discharge lamp 5 is high, so that application of the high voltage is likely cause breakage of the lamp. Therefore, it has been necessary to forbid relighting of the discharge lamp 5 while the temperature of the discharge lamp 5 is high.

In addition, a discharge gap in a discharge tube always changes as time passes and a discharge environment according to a discharge temperature always changes, so that a resonance frequency is different, while control of discharge is always set fixedly. This causes a problem that in often case the discharge lamp is not operating under an optimum condition.

SUMMARY OF THE INVENTION

An object of the invention is to provide a technique of efficiently lighting a discharge lamp.

According to one aspect of the present invention, there is provided a apparatus comprising a detector for detecting a discharge condition of a discharge lamp, a frequency changing unit for gradually changing a frequency of a voltage to be applied to the discharge lamp until the discharge condition reaches a predetermined lighting condition, and a voltage controller for controlling the voltage to be applied to the discharge lamp based on the frequency changed by the frequency changing unit.

The frequency which is used as a basis for voltage control is changed from start of discharge at a high voltage to a lighting condition at a low voltage so as to achieve stable discharge of the discharge lamp according to its discharge condition. This achieves stable lighting of the discharge lamp with high efficiency from the starting point of the discharge. A driving circuit is not necessarily supplied with high voltage, and high voltage is only induced in the discharge lamp. Accordingly, there is no need to provide high-voltage-driving circuitry as was the case with the conventional apparatus.

The frequency changing unit may monotonously increases the frequency of the voltage to be applied to the discharge lamp until the discharge condition reaches the lighting condition.

The frequency changing unit may variably adjust the frequency of the voltage to be applied to the discharge lamp responsive to the discharge condition detected by the detector so as to maintain the discharge lamp at the lighting condition even after the discharge condition reaches the lighting condition.

The present invention can be realized in various embodiments. For example, the present invention may be realized as a method of controlling a discharge lamp or an illumination apparatus comprising a discharge lamp and a discharge lamp controlling apparatus.

Further, the present invention may be realized as a projection type image display device comprising a discharge lamp, a projecting display part for using illumination light from the discharge lamp to project and display an image and a discharge lamp controlling apparatus.

BRIEF DESCRIPTION OF THE DRAWINGS

The invention will be described with reference to the accompanying drawings, wherein like numbers reference like elements, and wherein.

DESCRIPTION OF THE PREFERRED EMBODIMENT

A. An Outline of Embodiments

Figure 1:
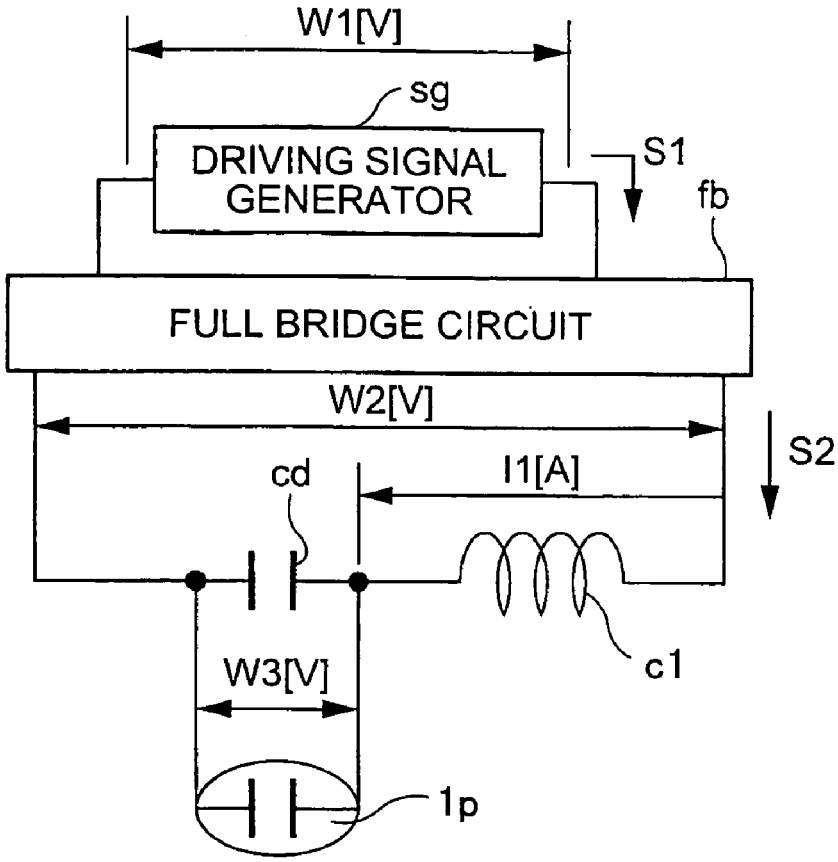
FIG. 1 illustrates a discharge lamp driving apparatus.

First, an outline of embodiments of the invention will be described, made reference to FIGS. 1 to 6. FIG. 1 illustrates a discharge lamp driving apparatus. The discharge lamp driving apparatus comprises a discharge lamp 1*p*, a resonance coil c1, a resonance condenser cd, a full bridge circuit fb and a driving signal generator sg. The resonance coil c1 is connected to the discharge lamp 1*p* in series while the resonance condenser cd is connected to the discharge lamp 1*p* in parallel. A circuit shown in FIG. 1 is a series resonant circuit in which the resonance coil c1 and the resonance condenser cd are equivalently arranged in series. Reactance of the resonance coil c1 and the resonance condenser cd is offset with each other at the resonance frequency, and impedance becomes close to zero accordingly. It is preferable to use a super E core (made by JFE Steel Corporation) superior in frequency characteristic of inductance rather than a ferrite material or a toroidal material as a core of the resonance coil.

The driving signal generator sg generates a driving signal (a switching signal) S1 of a voltage W1. The full bridge circuit fb carries out a switching operation in accordance with the driving signal S1 to generate an applied voltage signal S2 of a voltage W2. The applied voltage signal S2 causes a voltage W3 in the resonance condenser cd and current I1 flowing in the resonance coil c1. The voltage W3 and the current I1 will increase when the impedance becomes close to zero at the resonance frequency.

FIGS. 2 to 5 illustrate results of generating the driving signal S1 having various values of frequency fsc in the discharge lamp driving apparatus shown in FIG. 1. In the drawings, result displays are shown as it is. In FIGS. 2 to 5, the horizontal axis shows time. A dotted line is drawn every five marks of a scale in each drawing. FIGS. 2 to 5 respectively show four waveforms. A waveform Ch1 shows a waveform of the voltage W1 of the driving signal S1. One of marks in a graph of Ch1 indicates 5 volts. A waveform Ch2 shows a waveform of the voltage W2 of the applied voltage signal S2. One of marks in a graph of Ch2 indicates 5 volts. A waveform Ch3 shows a waveform of the voltage W3 across the condenser. One of marks in a graph of Ch3 indicates 100 volts. A waveform Ch4 shows a waveform of the current I1 flowing in the resonance coil c1. One of marks in a graph of Ch4 indicates 10 amperes.

In FIGS. 2 to 5, the voltage W1 of the driving signal S1 is all fixed at 25 volts and the driving signal S1 is changed only in frequency fsc. Further, in FIGS. 2 to 5, the voltage W2 of the applied voltage signal S2 is fixed at about 15 volts and a frequency of the voltage W2 coincides with the frequency fsc of the driving signal S1.

Figure 2:
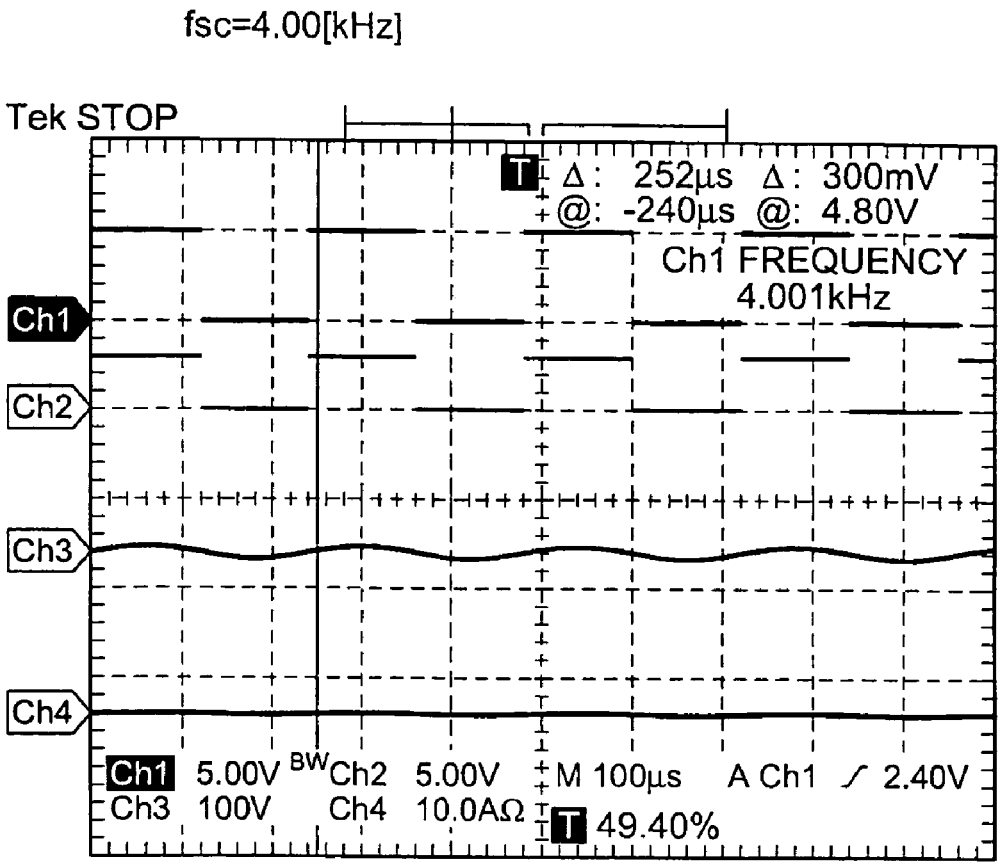
FIG. 2 is a diagram showing a result of generating a driving signal S1 having a frequency of 4.00 KHz.
Figure 3:
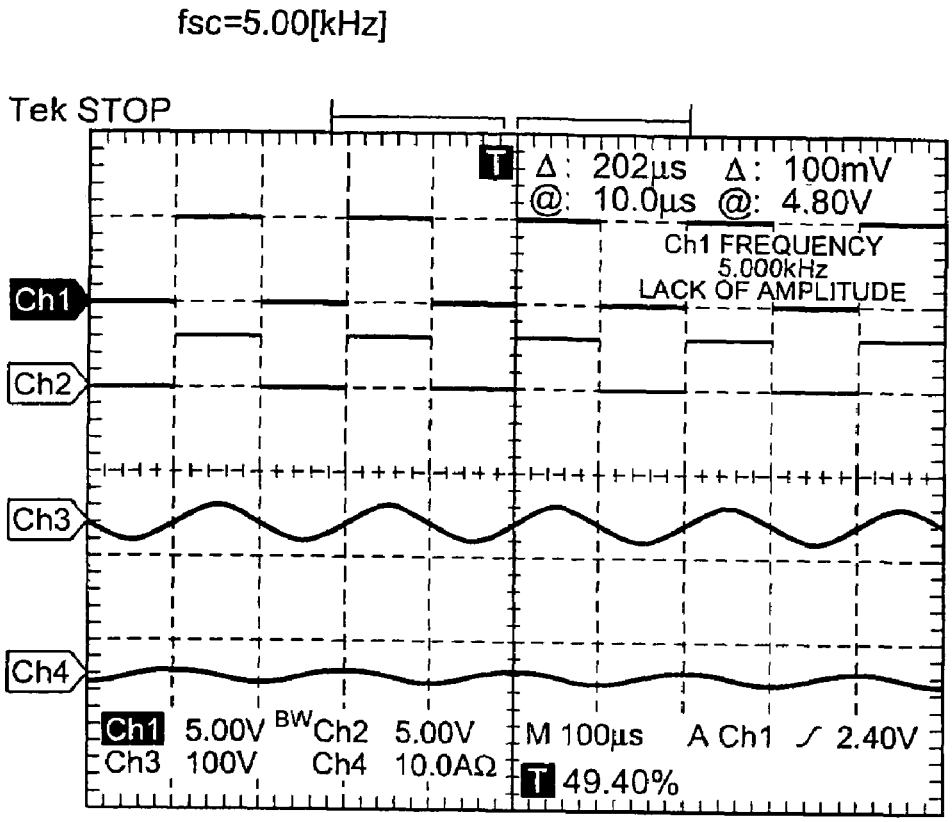
FIG. 3 is a diagram showing a result of generating a driving signal S1 having a frequency of 5.00 KHz.
Figure 4:
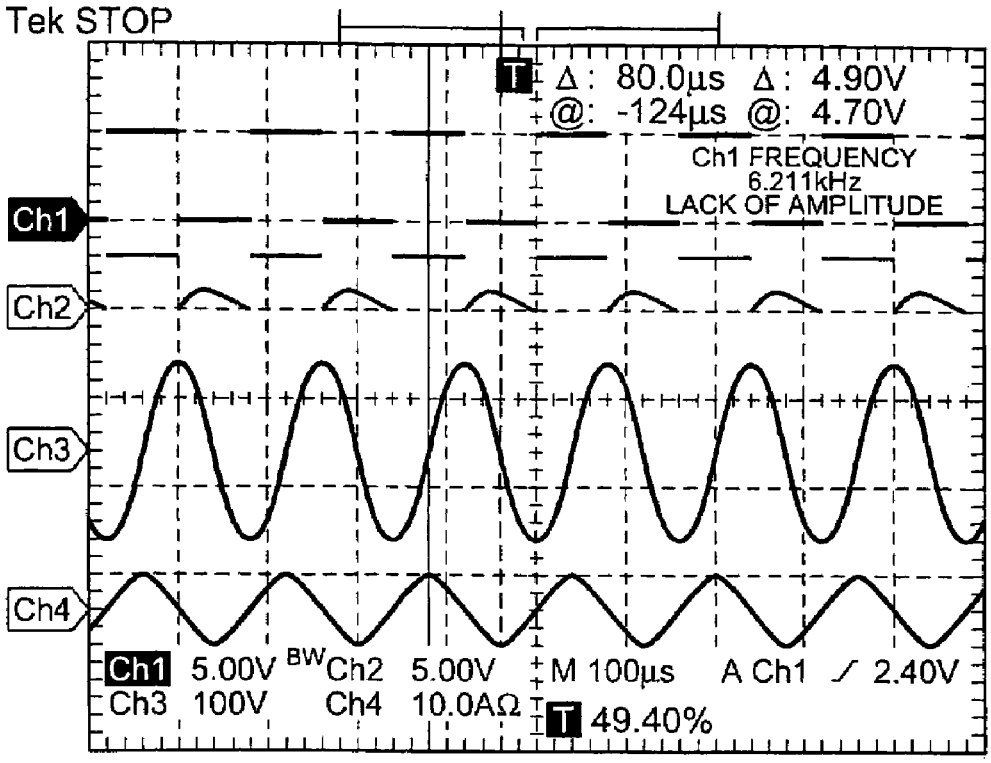
FIG. 4 is a diagram showing a result of generating a driving signal S1 having a frequency of 6.21 KHz.
Figure 5:
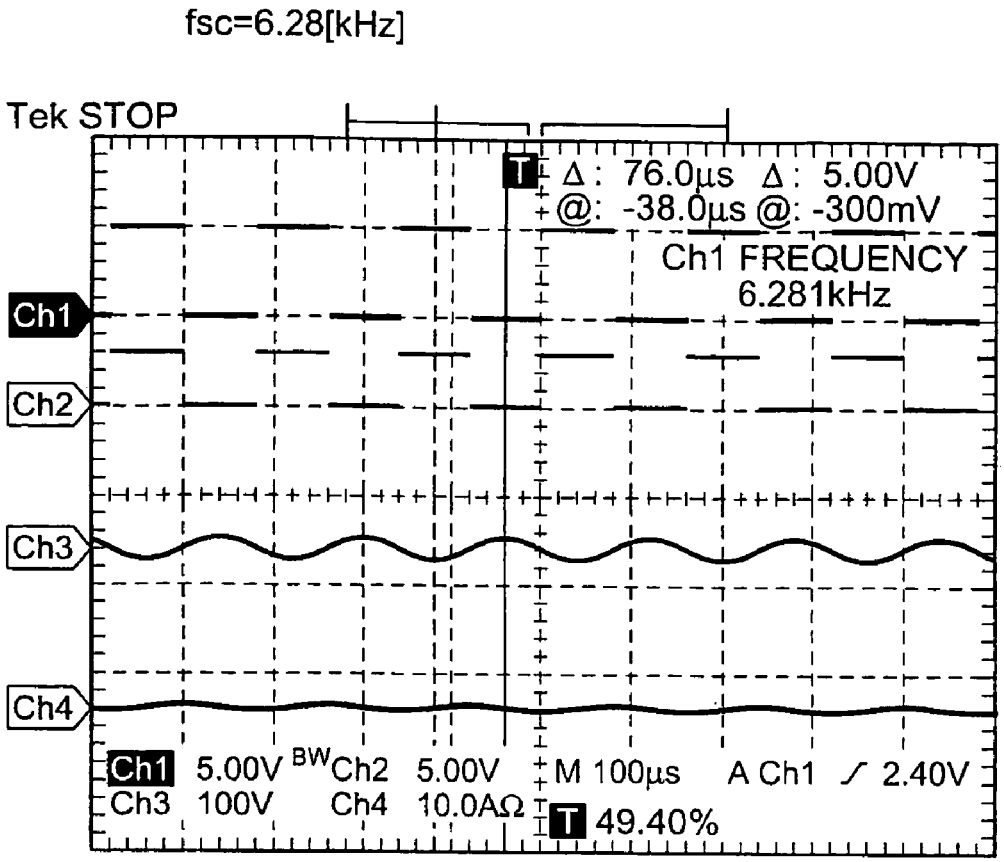
FIG. 5 is a diagram showing a result of generating a driving signal S1 having a frequency of 6.28 KHz.

FIG. 2 illustrates a result of generating the driving signal S1 having a frequency of 4.00 KHz. In the case of FIG. 2, the voltage W3 and the current I1 are negligible, so that it can be seen that the frequency of 4.00 KHz is not a resonant frequency. FIG. 3 illustrates a result of generating the driving signal S1 having a frequency of 5.00 KHz. In FIG. 3, the voltage W3 and the current I1 are more than those of FIG. 2. It can be seen that the frequency fsc is closer to the resonance frequency and the impedance is closer to zero. FIG. 4 illustrates a result of generating a driving signal S1 having a frequency of 6.21 KHz. In FIG. 4, the voltage W3 and the current I1 are increased, and thereby, it can be seen that the frequency of 6.21 KHz is the resonance frequency and the impedance is close to zero. FIG. 5 illustrates a result of generating a driving signal S1 having a frequency of 6.28 KHz. In FIG. 5, the voltage W3 and the current I1 are less than those of FIG. 4. It can be seen that the frequency fsc goes away from the resonance frequency and the impedance goes away from zero.

Figure 6:
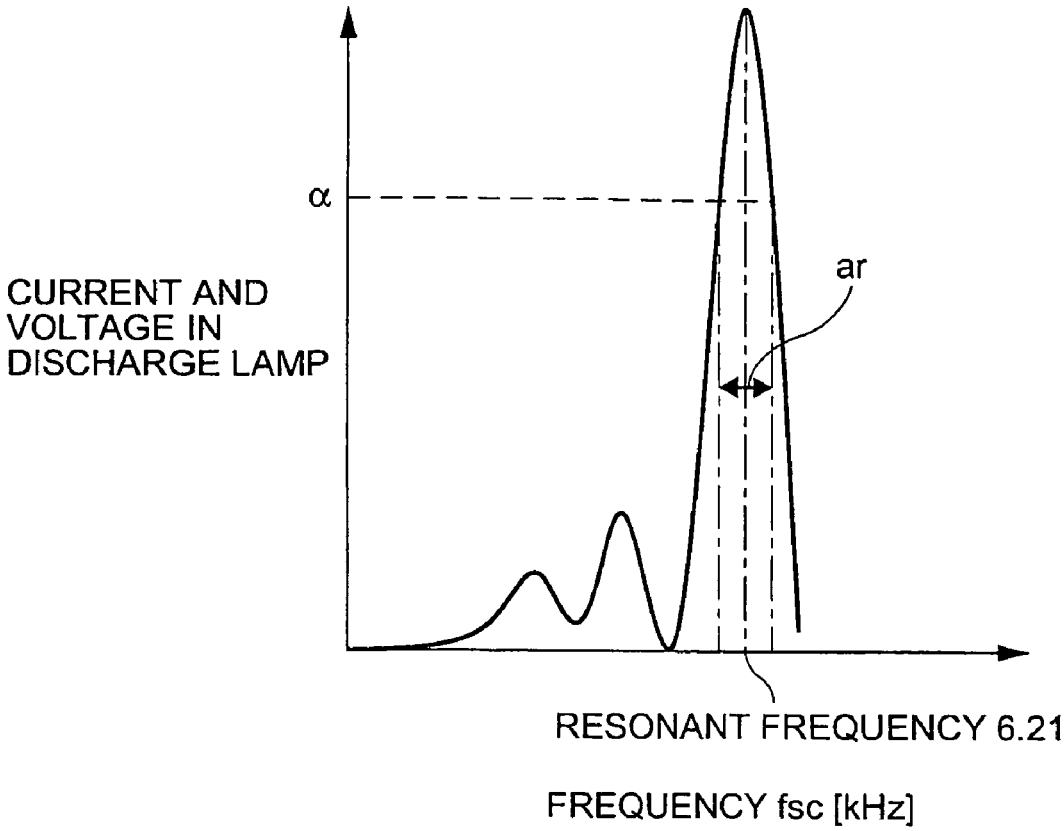
FIG. 6 illustrates current and voltage characteristics in a discharge lamp lp on the basis of results of experiments shown in FIGS. 2 to 5.

FIG. 6 illustrates current and voltage characteristics in the discharge lamp 1*p* on the basis of results of experiments in FIGS. 2 to 5. The horizontal axis shows the frequency fsc of the driving signal S1 while the vertical axis shows current or voltage in the discharge lamp 1*p*. The current and the voltage in the discharge lamp 1*p* vary in accordance with the frequency fsc and show the maximum values at the resonant frequency of 6.21 KHz. A frequency range in which the current and the voltage in the discharge lamp 1*p* are of a predetermined value a or more is called a resonant frequency range ar in the description. The discharge lamp 1*p* is lit with high efficiency in the resonant frequency range ar. Accordingly, it can be seen that the frequency fsc of the driving signal S1 could be adjusted so as to be within the resonant frequency range ar in order to light the discharge lamp 1*p*.

B. Embodiments

Figure 7:
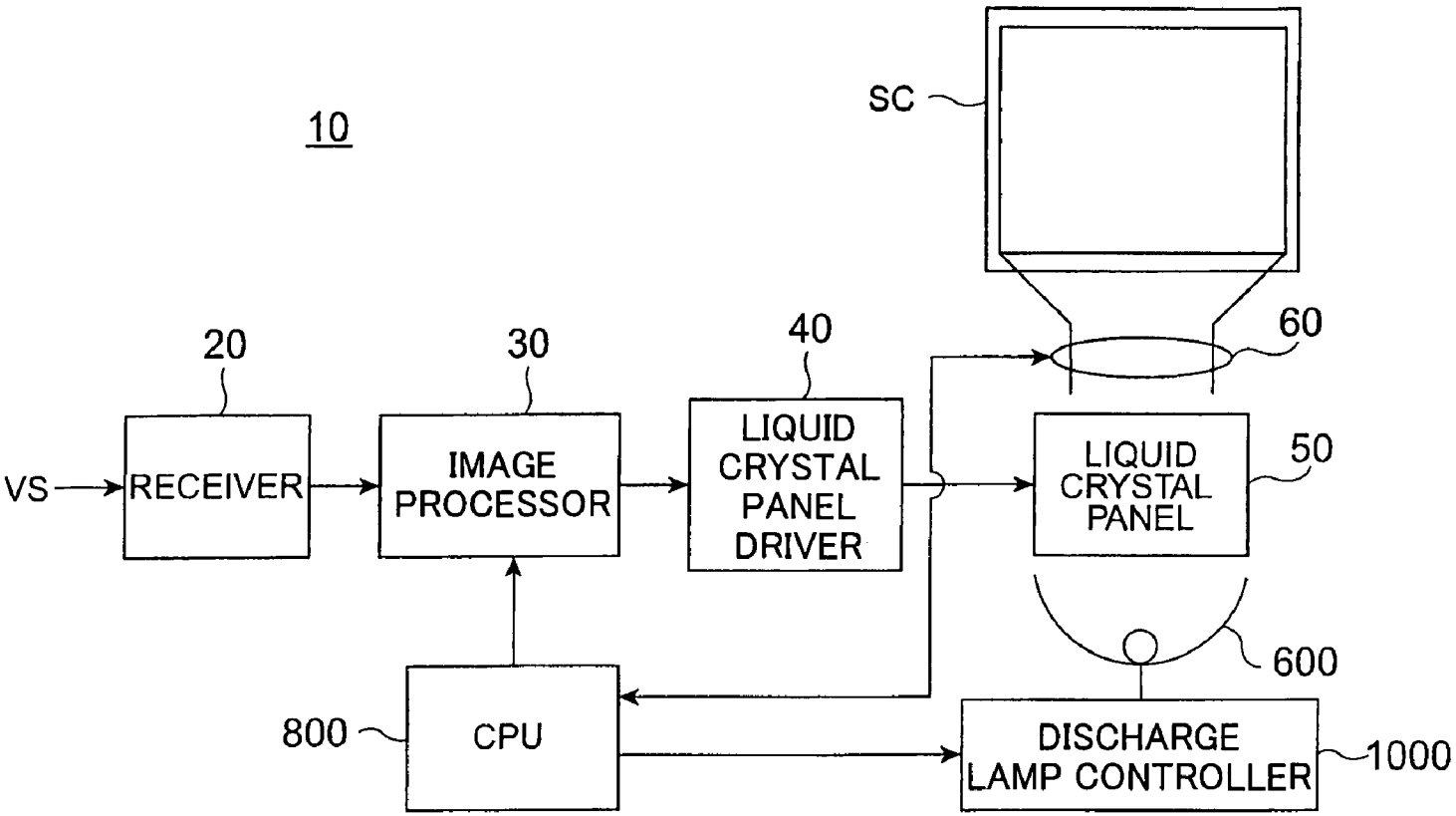
FIG. 7 illustrates a schematic structure of a liquid crystal projector as an embodiment of a projection type image display device in accordance with the invention.

FIG. 7 illustrates a schematic structure of a liquid crystal projector 10 as an embodiment of the invention. The liquid crystal projector 10 comprises a receiver 20, an image processor 30, a liquid crystal panel driver 40, a liquid crystal panel 50 as a light valve for modulating light, a projecting optical system 60 for projecting the modulated light on a screen SC, and a CPU 800. The liquid crystal projector 10 further comprises a discharge lamp 600 for illuminating the liquid crystal panel 50 and a discharge lamp controller 1000 for controlling the discharge lamp 600. A high pressure mercury lamp utilizing arc discharge is used as the discharge lamp 600 in the embodiment. Another discharge lamp such as a metal halide lamp or a Xenon lamp may be used as the discharge lamp 600 instead. The discharge lamp controller 1000 includes components corresponding to the driving signal generator sg, the resonance coil cl, the resonance condenser cd and the full bridge circuit fb shown in FIG. 1.

The receiver 20 receives an image signal VS supplied from a personal computer not shown or the like, and converts the inputted signal into image data in a form suitable for the image processor 30. The image processor 30 carries out various kinds of image processing such as brightness adjustment and color balance adjustment for the image data supplied from the receiver 20. The liquid crystal panel driver 40 generates a driving signal for driving the liquid crystal panel 50 responsive to the image data processed in the image processor 30. The liquid crystal panel 50 modulates illumination light in accordance with the driving signal generated in the liquid crystal panel driver 40. The projecting optical system 60 comprises a projecting lens having a zoom function (omitted from the drawings). The projecting optical system 60 varies a zoom ratio of the projecting lens, and thereby changes a focal length to change a size of a projected image with the projected image being in focus. The combination of the liquid crystal panel driver 40, the liquid crystal panel 50, and the projecting optical system 60 correspond to a projecting display unit of the invention for projecting and displaying an image with illumination light from the discharge lamp 600.

The CPU 800 controls the image processor 30 and the projecting optical system 60 in accordance with an operation of an operation button included in a remote controller not shown or a main body of the liquid crystal projector 10. Further, the CPU 800 has functions of setting a dimmer control value used in the discharge lamp controller 1000, instructing the discharge lamp controller 1000 to turn on the discharge lamp 600, and judging the remaining life of the discharging lamp 600. The CPU 800 corresponds to a dimmer control value setting unit, a period measuring unit and also a judging unit in the claimed invention. As for the functions of setting a dimmer control value and judging the remaining life of the discharge lamp 600, description will be made later. The combination of the discharge lamp controller 1000 and the CPU 800 correspond to the discharge lamp controlling device in the claimed invention.

Figure 8:
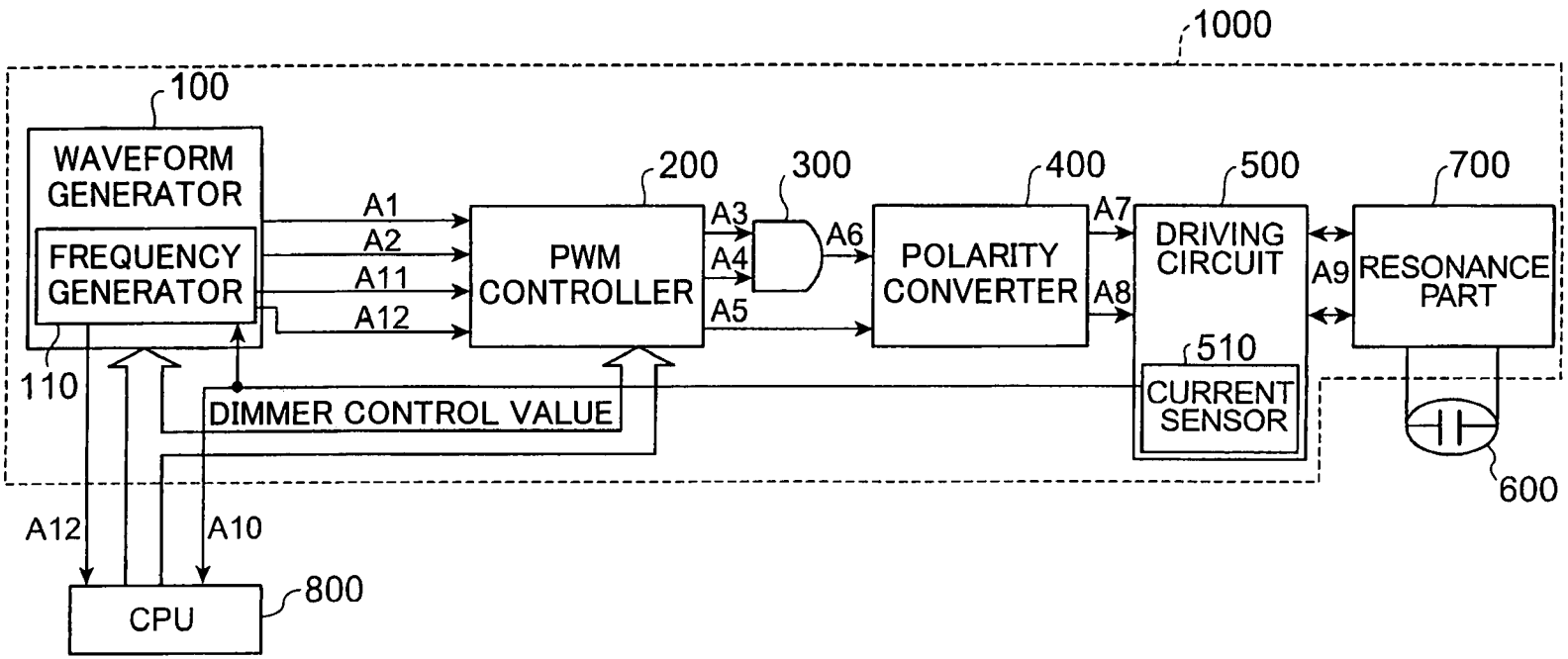
FIG. 8 is a block diagram of a discharge lamp controller.

FIG. 8 is a block diagram of the discharge lamp controller 1000. The discharge lamp controller 1000 comprises a waveform generator 100, a PWM controller 200, an AND circuit 300, a polarity converter 400, a driving circuit 500 and a resonance part 700. Functions of respective blocks will be described hereinafter, made reference to FIGS. 9, 10 and 13. The waveform generator 100 includes a frequency generator 110. The driving circuit 500 includes a current sensor 510.

Figure 9:
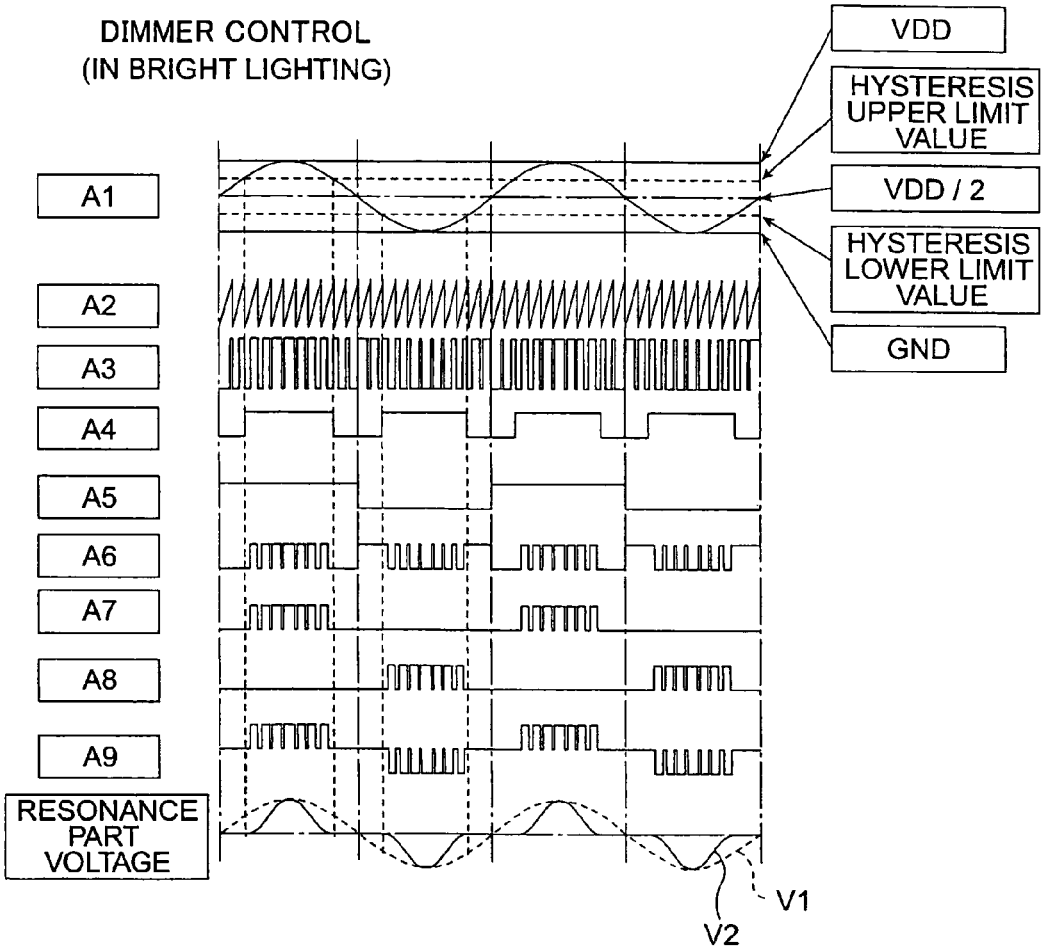
FIG. 9 is a timing chart in the case of modulating light into "bright lighting"
Figure 10:
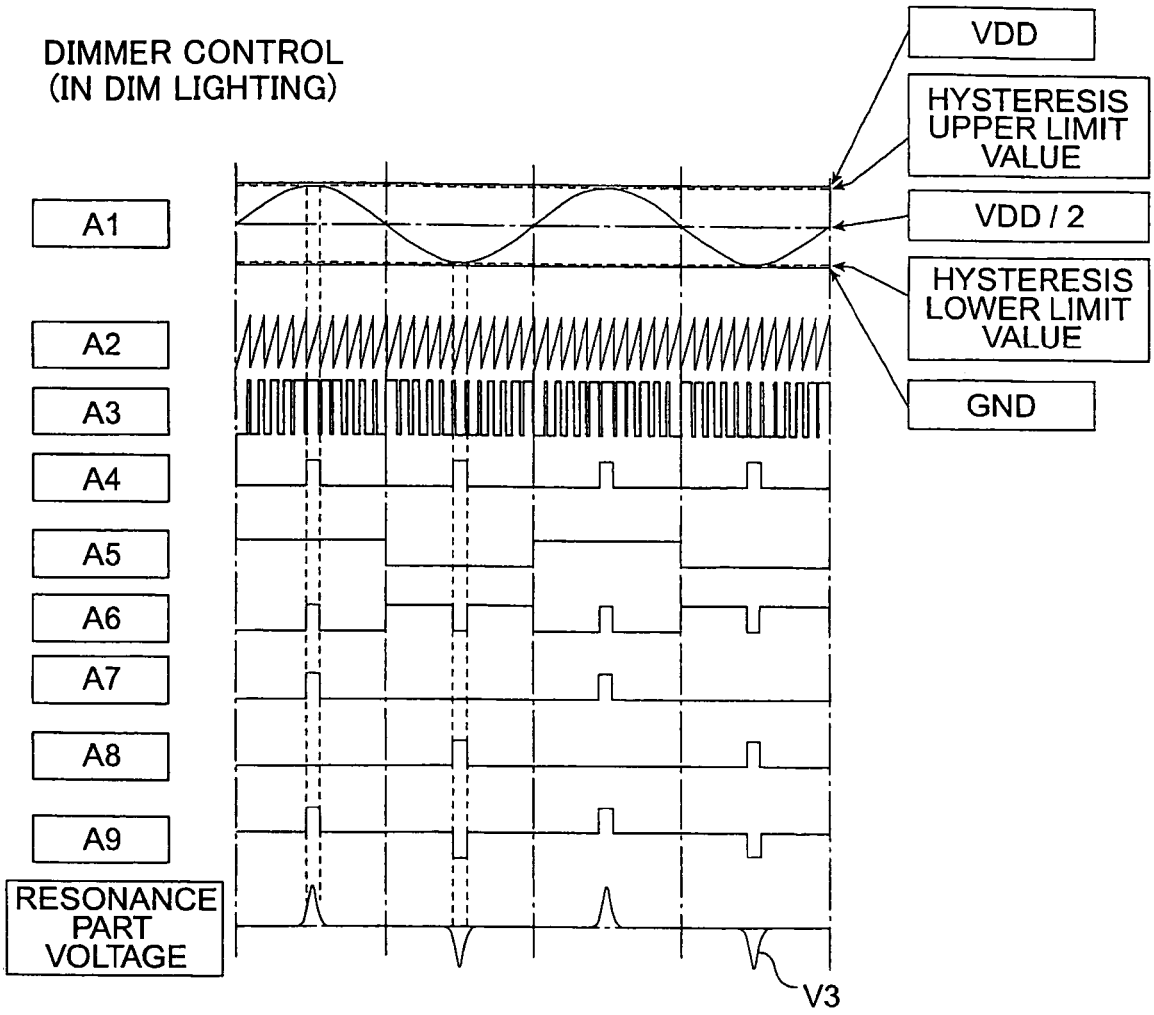
FIG. 10 is a timing chart showing signal waveforms of a signal A1 to a signal A9.
Figure 13:
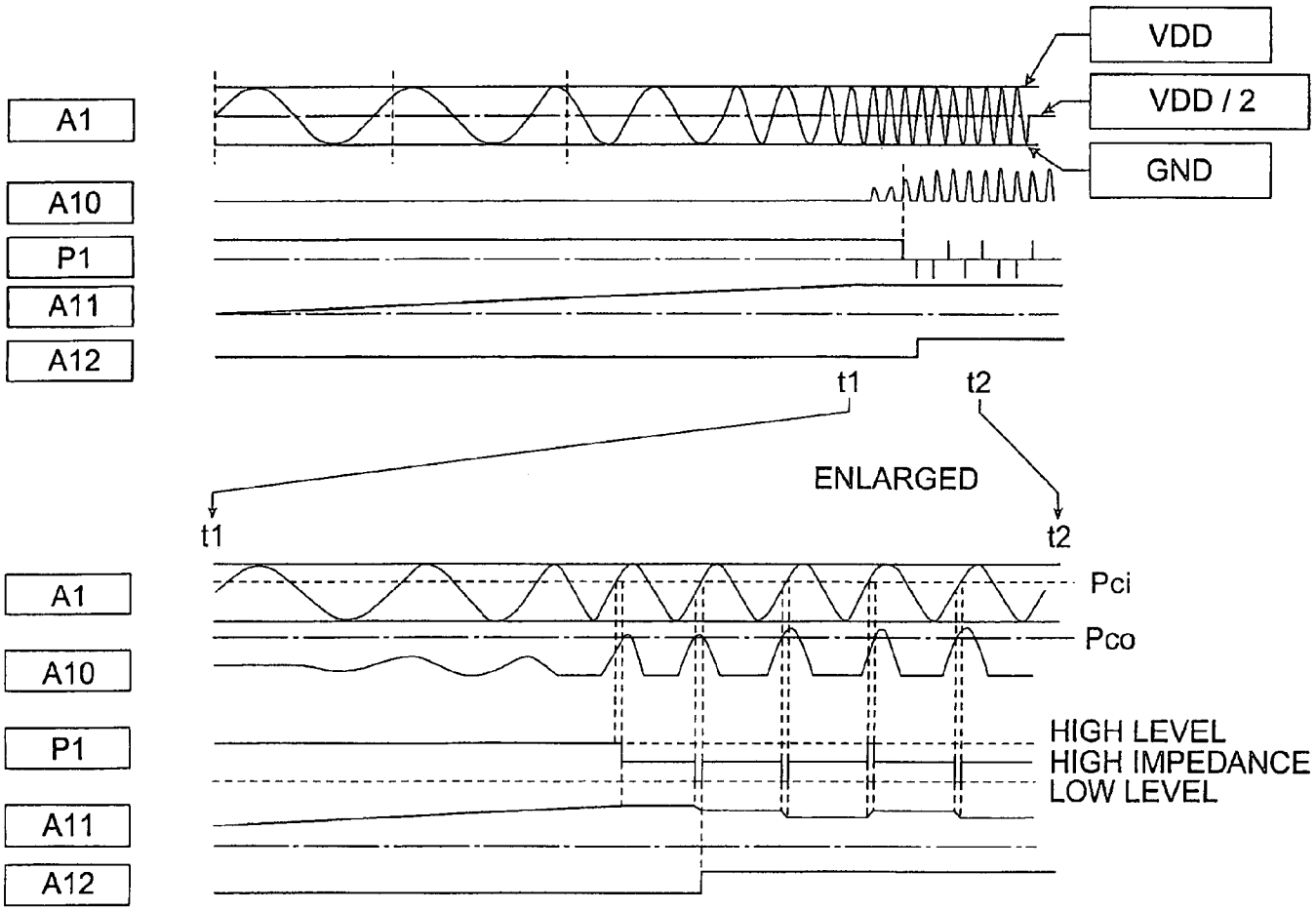
FIG. 13 is a timing chart showing signal waveforms of a sine wave signal A1, a resonance part signal A10, a phase difference signal P1, a frequency adjusting signal A11 and a lighting judging signal A12.

FIGS. 9 and 10 are timing charts showing signal waveforms of signals A1 to A9 shown in FIG. 8. FIG. 9 is a timing chart in the case of dimmer control in "bright lighting". FIG. 10 is a timing chart in the case of dimmer control in "dim lighting". The "bright lighting" means lighting, which is comparatively light, while the "dim lighting" means lighting, which is relatively dark. FIG. 13 is a timing chart showing waveforms of a sine wave signal A1, a resonance part signal A10, a phase difference signal P1, a frequency adjusting signal A11 and a lighting judging signal A12 in FIG. 8. The left end of FIG. 13, which is a starting point of the timing chart, is a point where control is changed from extinction to lighting of the lamp. The lower part of FIG. 13 is an enlarged timing chart in a period from the time t1 to t2.

The frequency generator 110 in FIG. 8 sets a frequency of the sine wave signal A1. The waveform generator 100 generates the sine wave signal A1 and a sawtooth wave signal A2 on the basis of the frequency set by the frequency generator 110 and a parameter set by the CPU 800. The PWM controller 200 generates a first PWM signal A3, a mask signal A4, a polarity signal A5 showing polarity of the sine wave signal A1, from the sine wave signal A1 and the sawtooth wave signal A2 using a dimmer control value given from the CPU 800. A difference in waveform of the mask signal A4 in FIGS. 9 and 10 is based on a difference in dimmer control value set by the CPU 800. As for the difference, description will be made in detail later. The AND circuit 300 generates a second PWM signal A6 from the first PWM signal A3 and the mask signal A4. A difference in waveform of the second PWM signal A6 in FIGS. 9 and 10 is based on a difference in the mask signal A4. The polarity converter 400 converts the polarity of the second PWM signal A6 on the basis of the polarity signal A5 to generate a first driving signal A7 and a second driving signal A8. The driving circuit 500 applies a voltage corresponding to the applying signal A9 to the resonance part 700 on the basis of the first driving signal A7 and the second driving signal A8. The PWM signal A3 is used so that a discharge waveform is PWM-controlled. The PWM signal A3 may be replaced by a rectangular wave without PWM control.

The resonance part voltages V2 and V3 in FIGS. 9 and 10 show voltage waveforms applied to the resonance part 700 when the voltage corresponding to the applying signal A9 is applied to the resonance part 700. A resonance part voltage V1 shown by a broken line in FIG. 9 is shown for the sake of convenience in description (as mentioned later). The resonance part 700 comprises the resonance coil c1 and the resonance condenser cd as shown in FIG. 1. In resonance, frequencies of the resonance part voltages V2 and V3 accord with the frequency of the sine wave signal A1. Accordingly, adjusting the frequency of the sine wave signal A1 allows the discharge lamp controlling apparatus 1000 to adjust the frequencies of the resonance part voltages V2 and V3 to light the discharge lamp 600 with high efficiency.

The current sensor 510 provided in the driving circuit 500 measures a current flowing in the resonance part 700 to give the frequency generator 110 feedback as the resonance part signal A10. The resonance part signal A10 is also inputted to the CPU 800. The current sensor 510 corresponds to the detector in the claimed invention. The frequency generator 110 determines a frequency of the sine wave signal A1 on the basis of a result of comparison of phase of the sine wave signal A1 and that of the resonance part signal A10 detected by the current sensor 510, and generates the frequency adjusting signal A11 and the lighting judging signal A12. Details of the frequency generator 110 will be described later.

The waveform generator 100, the PWM controller 200, the AND circuit 300, the polarity converter 400, the driving circuit 500 and the resonance part 700 will be described below in detail.

Figure 11:
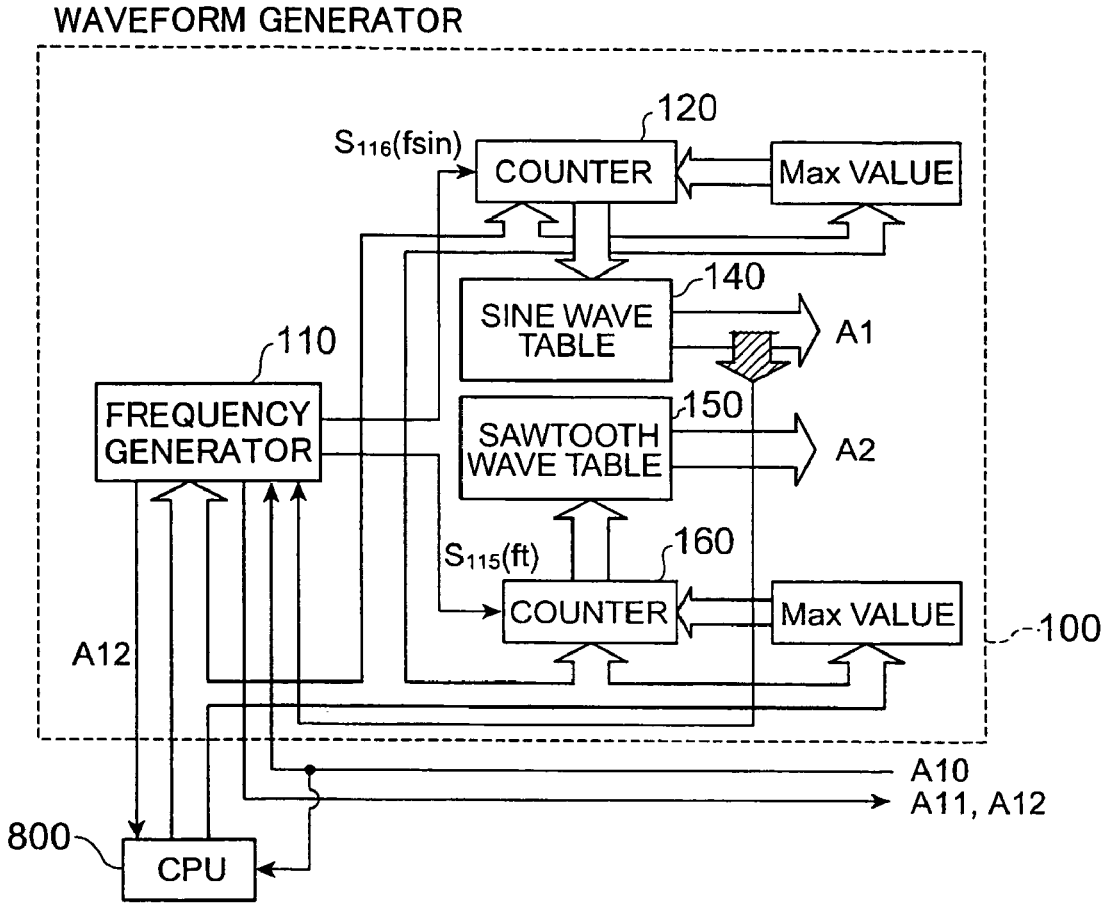
FIG. 11 is a block diagram of a waveform generator.

FIG. 11 is a block diagram of the waveform generator 100. The waveform generator 100 comprises the frequency generator 110, a counter 120, a sine wave table 140, a sawtooth wave table 150 and a counter 160.

Figure 12:
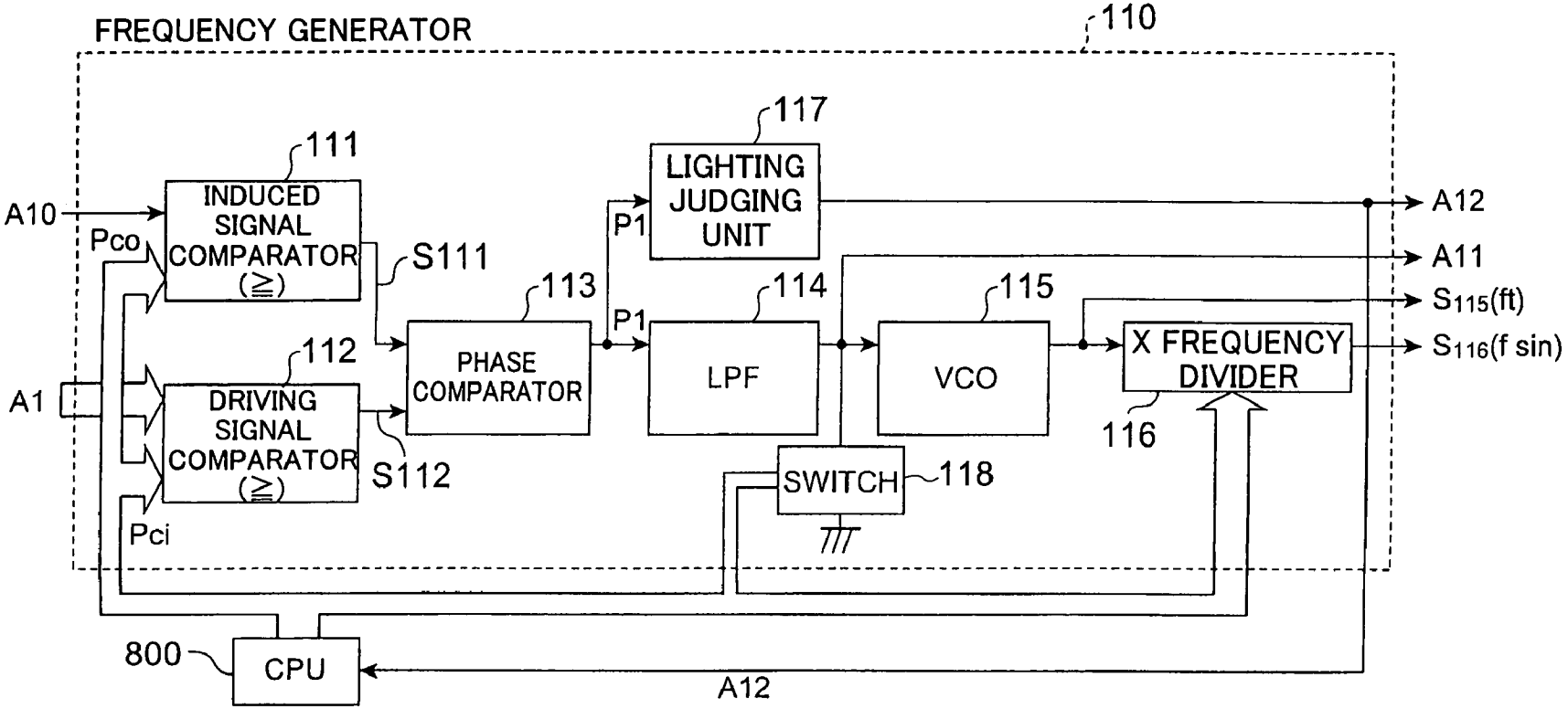
FIG. 12 is a block diagram of a frequency generator of the waveform generator.

FIG. 12 is a block, diagram showing the inner structure of the frequency generator 110 in the waveform generator 100. The frequency generator 110 comprises an induced signal comparator 111, a driving signal comparator 112, a phase comparator 113, a loop filter 114, a voltage controlling oscillator (VCO) 115, an X frequency divider 116, a lighting judging unit 117 and a switch 118. The loop filter (LPF) 114 includes an integral circuit and a low pass filter. Functions of respective elements will be described below with reference to FIG. 13.

The CPU 800 sets a parameter Pco and a parameter Pci for the induced signal comparator 111 and the driving signal comparator 112, respectively. The induced signal comparator 111 compares a signal value of the resonance part signal A10 and the parameter Pco to set an output signal S111 thereof at an H level in the case of Pco≦A10 and at an L level in the case of A10<Pco. The driving signal comparator 112 compares the parameter Pci and the sine wave signal A1 to set an output signal S112 thereof at the H level in the case of Pci≦A1 and at the L level in the case of A1<Pci.

The phase comparator 113 compares phases of the inputted two signals S111 and S112 to output a comparison result as the phase difference signal P1. The phase comparator 113 changes a level of the output signal P1 when there is a difference in phase between the two signals S111 and S112, that is, between the signals A1 and A10. In more concrete terms, a low level signal is outputted as the phase difference signal P1 when the resonance part signal A10 has an advance phase on that of the sine wave signal A1 while a high level signal is outputted in the case of a delay phase or no signal. The phase difference signal P1 is kept to be in a high impedance state when the phases of the sine wave signal A1 and the resonance part signal A10 are accorded each other.

The LPF 114 generates the frequency adjusting signal A11 from the phase difference signal P1 and outputs the frequency adjusting signal A11. As it is seen from the lower part of FIG. 13, the LPF 114 monotonously increases the frequency adjusting signal A11 when the phase difference signal P1 is at the high level, fixes the frequency adjusting signal A11 when the phase difference signal P1 is at the high impedance state and monotonously decreases the frequency adjusting signal A11 when the phase difference signal P1 is at the low level. That is to say, the LPF 114 integrates the phase difference signal P1 to remove the alternating current component to produce the frequency adjusting signal A11. The wire for the frequency adjusting signal A11 is earthed through the switch 118. The switch 118 is controlled by the CPU 800 so as to be turned on for extinction of the lamp and turned off for lighting of the lamp. That is to say, the frequency adjusting signal A11 is fixed at the ground level when the lamp is extinguished while the signal A11 operates effectively after the CPU 800 instructs the frequency generator 110 to light the discharge lamp 600.

The voltage controlling oscillator (VCO) 115 generates a rectangular wave signal $S_{115}$ having a frequency ft responsive to the level of the frequency adjusting signal A11. In other words, the VCO 115 increases the frequency ft of the rectangular wave signal $S_{115}$ as the level of the frequency adjusting signal A11 increases. The X frequency divider 116 divides the frequency of the rectangular wave signal $S_{115}$ by a value X to output a rectangular wave signal $S_{116}$ having a frequency f sin. That is to say, a relation expressed by the following formula 1 is satisfied.

$$f\sin = ft/X \quad (1)$$

The frequency f sin is a basic frequency for generating the sine wave signal A1. This will be described later in detail. Accordingly, as mentioned above, adjusting the frequency f sin allows power applied to the discharge lamp 600 to be adjusted. As it can be seen from the lower part of FIG. 13, the frequency f sin of the sine wave signal A1 increases or decreases in accordance with increase or decrease of the frequency adjusting signal A11. Receiving an instruction of lighting the discharge lamp 600 from the CPU 800, the frequency generator 110 monotonously increases the frequency f sin because there is no resonance part signal A10 at that time. When the frequency f sin is raised close enough to the resonance frequency, which is determined by the resonance coil c1 and the resonance condenser cd, a voltage across the discharge lamp 600 increases to start the discharge. After the discharge starts, the discharge lamp 600 is short-circuited so that a large amount of current would flow. A difference between the current phase thereof and the voltage phase on the supplying side allows a proper frequency adjustment to be carried out and this causes a stable discharge lighting condition. The frequency f sin may be monotonously increased until the discharge lamp 600 would become a predetermined lighting condition.

The lighting judging unit 117 generates and outputs the lighting judging signal A12 on the basis of the phase difference signal P1. The lighting judging signal A12 is to be used as a criteria for judging whether or not the discharge lamp 600 reaches the predetermined lighting condition. The lighting judging signal A12 being 0 (at the low level) indicates judgment of the frequency generator 110 that the discharge lamp 600 has not yet reached the lighting condition. The lighting judging signal A12 being 1 (at the high level) indicates judgment that the discharge lamp 600 has reached the lighting condition. That is to say, the lighting judging signal A12 shows judgment of the frequency generator 110, and therefore, the discharge lamp 600 may have reached the lighting condition in some cases before the lighting judging signal A12 reaches the high level, in practice. As shown in the lower part of FIG. 13, the lighting judging unit 117 first outputs the lighting judging signal A12 at the low level and changes the same into the high level when the phase difference signal P1 takes the high impedance state for the second time. That is to say, the light judging unit 117 judges whether or not the discharge lamp 600 reaches the predetermined lighting condition in accordance with judgment whether or not a difference in phase between the resonance part signal A10 and the sine wave signal A1 is within a predetermined range. In the embodiment, the lighting judging unit 117 outputs the lighting judging signal A12 at the high level when the phase difference signal P1 takes the high impedance state for the second time. This means that the discharge lamp 600 is judged to be in a proper lighting condition when the phase difference signal P1 takes the high impedance state for the second time. The present invention, however, is not limited to the above, and, for example, the judgment of lighting condition may be given when the phase difference signal P1 takes the high impedance state at least once. A fact that the phase difference signal P1 takes the high impedance state for a predetermined times corresponds to a fact that a difference in phase between the voltage or the current applied to the discharge lamp at the lighting starting time and the induced voltage or the induced current in the discharge lamp is within a predetermined range.

When the frequency generator 110 judges that the discharge lamp 600 reaches a predetermined lighting condition, it varies the frequency f sin on the basis of a result of the phase comparison between the resonance part signal A10 and the sine wave signal A1 (namely, the phase difference signal P1) so that the phase difference would be within a predetermined range in order to maintain the lighting condition. In the embodiment, the frequency f sin is adjusted on the basis of a result of the phase comparison between the resonance part signal A10 and the sine wave signal A1 before it is judged that the discharge lamp 600 reaches the predetermined lighting condition (before the lighting judging signal A12 reaches the high level). The phase of the resonance part signal A10 corresponds to that of the induced current in the claimed invention while the phase of the sine wave signal A1 corresponds to "a phase of the voltage applied to the discharge lamp" in the claimed invention. That is to say, the frequency generator 110 corresponds to the frequency changing unit in the claimed invention.

The CPU 800 is able to adjust the timing for carrying out phase comparison by properly changing the parameters Pci and Pco. The CPU 800 is also capable of adjusting a ratio between the frequency ft and the frequency f sin by changing the parameter X. The parameters Pci and Pco may be adjusted by the CPU 800 after the discharge lamp 600 is turned on. This causes a change in difference in phase between the sine wave signal A1 and the resonance part signal A10, and thus, the frequency f sin is set variably. This allows the frequency f sin to be changed at the resonance point (the maximum power point), so that power adjustment can be performed at any time, and thereby, the dimmer control can be easily achieved.

Returning to FIG. 11 again, the waveform generator 100 will be described now. The rectangular wave signal $S_{116}$ having the frequency f sin and the rectangular wave signal $S_{115}$ having the frequency ft, which are outputted from the frequency generator 110, are respectively inputted to the counter 120 and the counter 160. The counter 120 counts a pulse number of the rectangular wave signal $S_{116}$ up to a Max value and restarts counting from an initial value after the pulse number reaches the Max value. The sine wave table 140 outputs data A1 representing the count of the counter 120. In the drawing of the sine wave signal A1 in FIG. 9 and 10, the horizontal axis corresponds to the count of the counter 120 while the vertical axis corresponds to the data outputted from the sine wave table 140. The counter 120 and the sine wave table 140 thus output the sine wave signal A1 on the basis of the rectangular wave signal $S_{116}$. The sine wave signal A1 varies between GND and VDD, as shown in FIGS. 9, 10 and 13. A data value at GND is represented by "0" in an 8-bits signal while a data value at VDD is represented by "255" in an 8-bits signal. "A hysteresis upper limit value" and "a hysteresis lower limit value" in FIGS. 9 and 10 will be described later.

The counter 160 and the sawtooth wave table 150 also output a sawtooth wave signal A2 on the basis of the rectangular wave signal $S_{115}$ having the frequency ft, similarly to the above. The sine wave signal A1 in FIGS. 9 and 10 has a waveform other than a rectangle and corresponds to the reference wave signal in the claimed invention. The sawtooth wave signal A2 in FIGS. 9 and 10 is shorter in wavelength than the sine wave signal A1, has a waveform other than a rectangle and corresponds to the comparison wave signal in the claimed invention. The waveform generator corresponds to the signal generator in the claimed invention.

The CPU 800 can adjust waveforms of the sine wave signal A1 and the sawtooth wave signal A2 by properly changing the Max values and the initial values of the counter 120 and the counter 160. The sine wave signal A1 and the sawtooth wave signal A2 are supplied from the waveform generator 100 to the PWM controller 200 as shown in FIG. 8. The frequency adjusting signal A11 and the lighting judging signal A12 are supplied from the frequency generator 110 to the PWM controller 200. Further, the sine wave signal A1 is fed back to the driving signal comparator 112 of the frequency generator 110 as described above.

Figure 14:
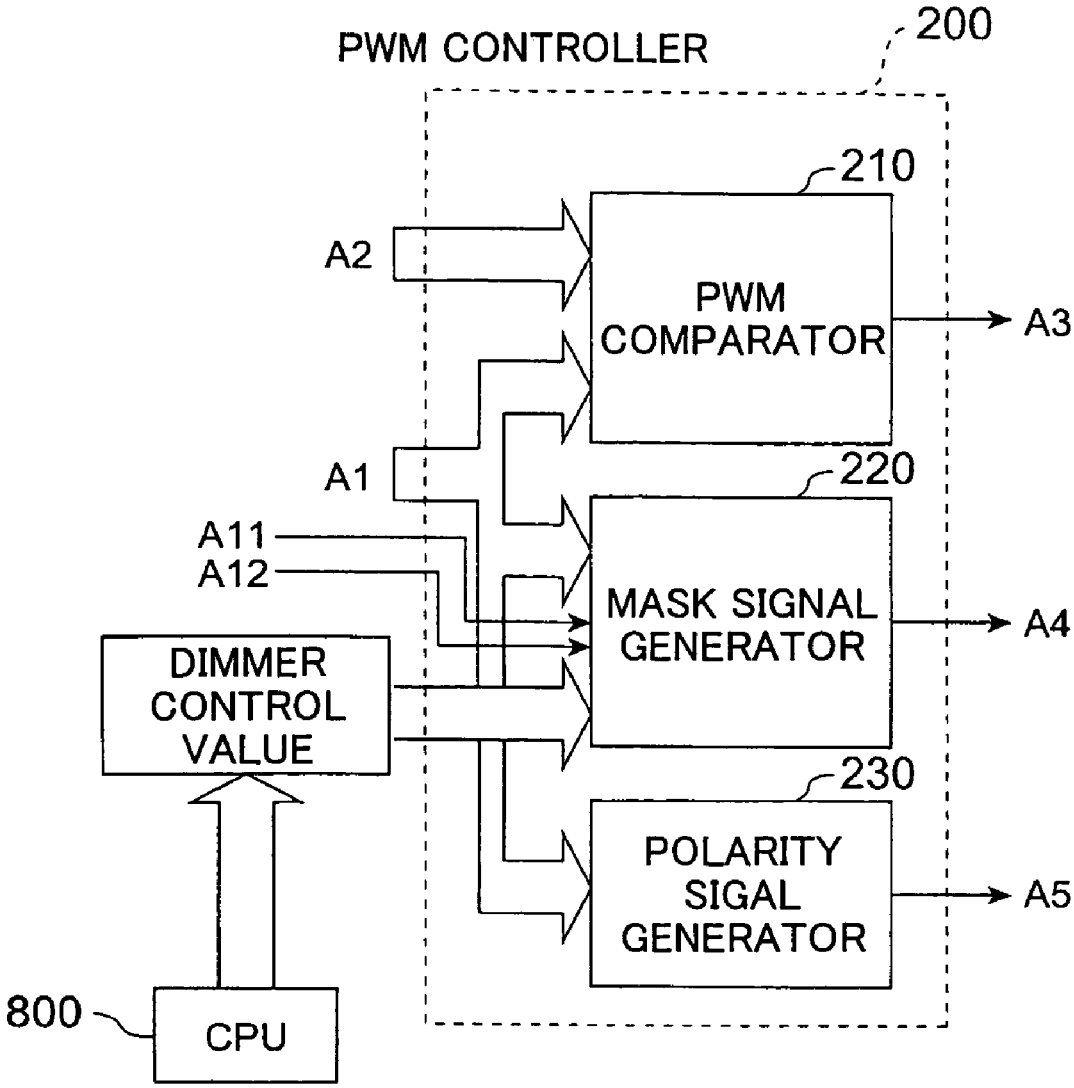
FIG. 14 is a block diagram of a PWM controller.

FIG. 14 is a block diagram of the PWM controller 200. The PWM controller 200 comprises a PWM comparator 210, a mask signal generator 220 and a polarity signal generator 230. The PWM comparator 210 compares the sine wave signal A1 and the sawtooth wave signal A2 to generate the first PWM signal A3. The PWM comparator 210 corresponds to the first PWM signal generator in the claimed invention.

The mask signal generator 220 receives the sine wave signal A1, a dimmer control value for adjusting the brightness of the discharge lamp 600, the frequency adjusting signal A11 and the lighting judging signal A12, and outputs the mask signal A4.

Figure 15:
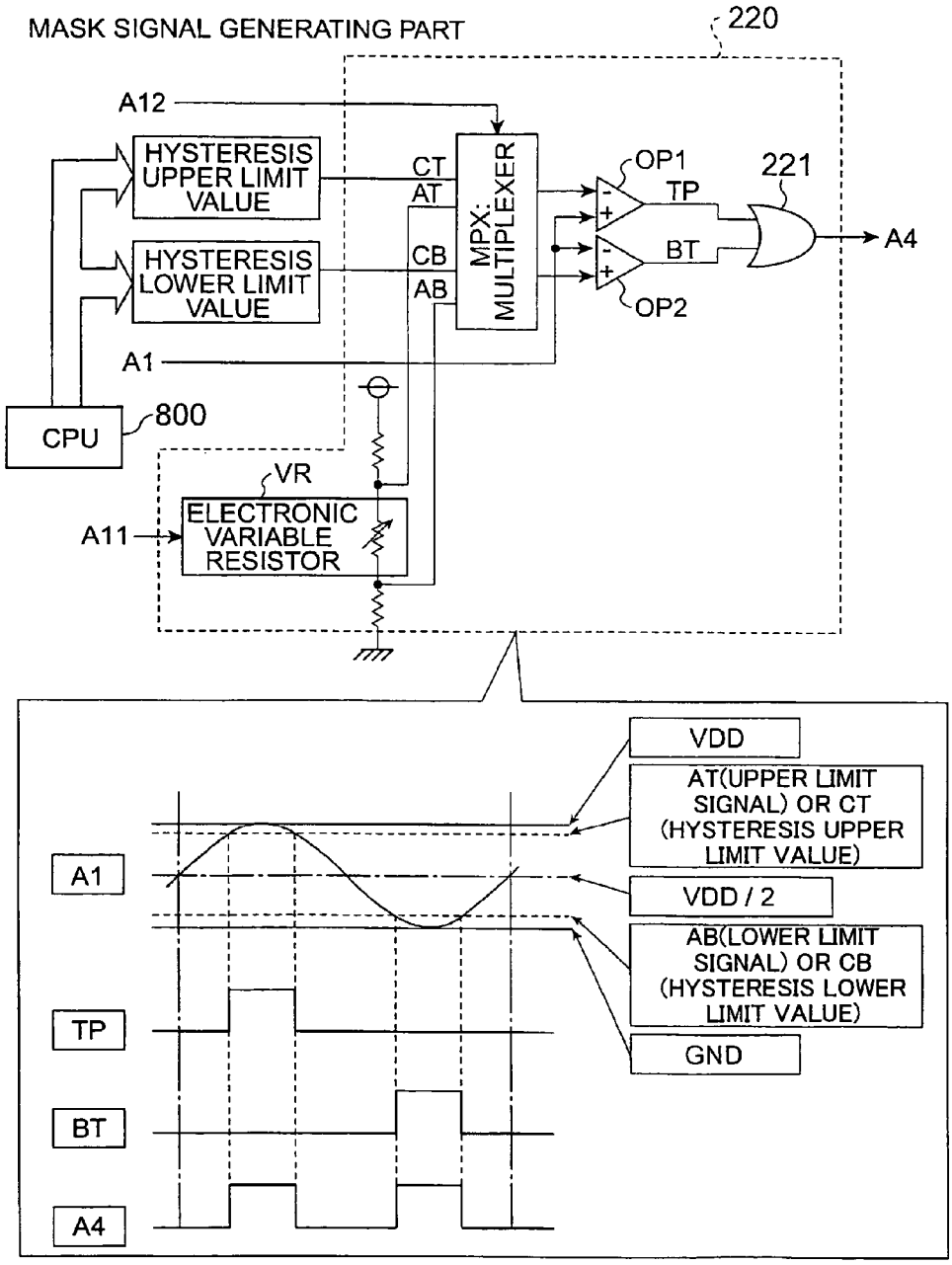
FIG. 15 illustrates an inner structure of a mask signal generator.

FIG. 15 illustrates an inner structure of the mask signal generator 220. The mask signal generator 220 comprises an electronic variable resistor VR, a multiplexer MPX, two operational amplifiers OP1 and OP2 and an OR circuit 221. The electronic variable resistor VR is capable of changing the resistance value responsive to the frequency adjusting signal A11 (FIG. 12), thereby changing both of an upper limit signal AT and a lower limit signal AB in accordance with the frequency adjusting signal A11. The "hysteresis upper limit value" and the "hysteresis lower limit value" in FIG. 15 are dimmer control values set by the CPU 800, the values being constants. As shown in the lower part of FIG. 15, the hysteresis upper limit value CT and the hysteresis lower limit value CB are set so that their differences from a value corresponding to VDD/2 (128 in an 8-bits signal) would be equal each other. The upper limit signal AT and the lower limit signal AB do not necessarily change as described above.

The multiplexer MPX switches signals to be outputted to the operational amplifier OP1 and the operational amplifier OP2 in accordance with whether the lighting judging signal A12 is 1 or 0. The multiplexer MPX outputs the upper limit signal AT to the operational amplifier OP1 and the lower limit signal AB to the operational amplifier OP2 when the lighting judging signal A12 is 0. On the other hand, the multiplexer MPX outputs the hysteresis upper limit value CT to the operational amplifier OP1 and the hysteresis lower limit value CB to the operational amplifier OP2 when the lighting judging signal A12 is 1.

The first operational amplifier OP1 generates a first mask signal TP from the sine wave signal A1 and either of the upper limit signal AT and the hysteresis upper limit value CT. As shown in the lower part of FIG. 15, the mask signal TP takes the H level in a time range where the sine wave signal A1 is greater than or equal to the upper limit signal AT or the hysteresis upper limit value CT, while it takes the L level in the other time range. The second operational amplifier OP2 generates a second mask signal BT from the sine wave signal A1 and either of the lower limit signal AB and the hysteresis lower limit value CB. As shown in the lower part of FIG. 15, the mask signal BT takes the H level in a time range where the sine wave signal A1 is greater than or equal to the lower limit signal AB or the hysteresis lower limit value CB, while it takes the L level in the other time range.

The OR circuit 221 generates the mask signal A4 from the two mask signals TP and BT. As shown in the lower part of FIG. 15, the mask signal A4 takes the H level in a time range where the sine wave signal A1 is greater than or equal to the upper limit signal AT or the hysteresis upper limit value CT and also in another time range where the sine wave signal A1 is greater than or equal to the lower limit signal AB or the hysteresis lower limit value CB, while it takes the L level in the other time range.

As mentioned above, the lighting judging signal A12 (FIGS. 12 and 13) is to be used as a criteria for judging whether or not the discharge lamp 600 reaches the lighting condition. The lighting judging signal A12 being 0 indicates judgment that the discharge lamp 600 has not yet reached the lighting condition while the lighting judging signal A12 being 1 indicates judgment that the discharge lamp 600 has reached the lighting condition. Accordingly, the mask signal generator 220 has a function of generating the mask signal A4 from the upper limit signal AT and the lower limit signal AB, which correspond to the frequency adjusting signal A11, before the discharge lamp 600 reaches the lighting condition and generating the mask signal from the hysteresis upper limit value CT and the hysteresis lower limit value CB, which are values set by the CPU 800, after the discharge lamp 600 reaches the lighting condition.

As it can be seen from the above-mentioned process of generating the mask signal A4, a time range where the signal TP takes the H level is narrowed when the upper limit signal AT is made large or when the hysteresis upper limit value CT is made large while the time range where the signal TP takes the H level is widened when the upper limit signal AT is made small or when the hysteresis upper limit value CT is made small. The mask signal A4 is thus adjusted in accordance with change of the upper limit signal AT or the hysteresis upper limit value CT. This is also true of the lower limit signal AB or the hysteresis lower limit value CB. The mask signal A4 acts as a signal for adjusting the brightness of the discharge lamp 600. The wider the time range where the mask signal A4 takes the H level is the more the brightness of the discharge lamp 600 increases. This will be described later in detail. Accordingly, the CPU 800 and the electronic variable resistor VR respectively correspond to the dimmer control value setting unit in the claimed invention for adjusting the brightness of the discharge lamp 600 by setting the hysteresis upper limit value CT and the hysteresis lower limit value CB, which are the dimmer control values, or the upper limit signal AT and the lower limit signal AB.

In more concrete terms, the CPU 800 decreases the hysteresis upper limit value CT and increases the hysteresis lower limit value CB for bright lighting. This allows the mask signal A4 in bright lighting to take the H level in a wider time range, as shown in FIG. 9. On the other hand, the CPU 800 increases the hysteresis upper limit value CT and decreases the hysteresis lower limit value CB for dark lighting shown in FIG. 10. This allows the mask signal A4 in dark lighting to take the H level in a narrower time range. In the embodiment, the hysteresis lower limit value CB is given by (255−CT). The hysteresis upper limit value CT and the hysteresis lower limit value CB, however, may be set independently.

Returning to FIG. 14 again, the polarity signal generator 230 of the PWM controller 200 generates the polarity signal A5 which takes the H level when the sine wave signal A1 is positive (a range with a phase from 0 to $\pi$) and which takes the L level when the sine wave signal A1 is negative (a range with a phase from $\pi$ to $2\pi$). As described above, the PWM controller 200 outputs the first PWM signal A3, the mask signal A4 and the polarity signal A5.

As shown in FIG. 8, the first PWM signal A3 and the mask signal A4, which are outputted from the PWM controller 200, are inputted to the AND circuit 300. The AND circuit 300 generates the second PWM signal A6 from the first PWM signal A3 and the mask signal A4. As seen from the waveforms of the second PWM signal A6 in FIGS. 9 and 10, the mask signal A4 can be considered to be a signal which transmits the first PWM signal A3 as the second PWM signal A6 when the mask signal A4 takes the H level, and which blocks or masks the first PWM signal A3 to make the second PWM signal A6 zero when the mask signal A4 takes the L level. Therefore, the signal A4 is called "a mask signal". It may be called "an allowance signal". The mask signal generator 220 and the AND circuit 300 mask the first PWM signal A3 on the basis of the dimmer control value to generate the second PWM signal A6. Accordingly, The mask signal generator 220 and the AND circuit 300 correspond to the second PWM signal generator or the driving signal generator in the claimed invention.

The second PWM signal A6 and the polarity signal A5 are inputted to the polarity converter 400, which outputs the first and second driving signals A7 and A8. The first driving signal A7 corresponds to the second PWM signal A6 in a time range where the polarity signal A5 takes the H level as shown in FIGS. 9 and 10. The second driving signal A8 is generated by reversing the polarity of the second PWM signal A6 in a time range where the polarity signal A5 takes the L level.

Figure 16:
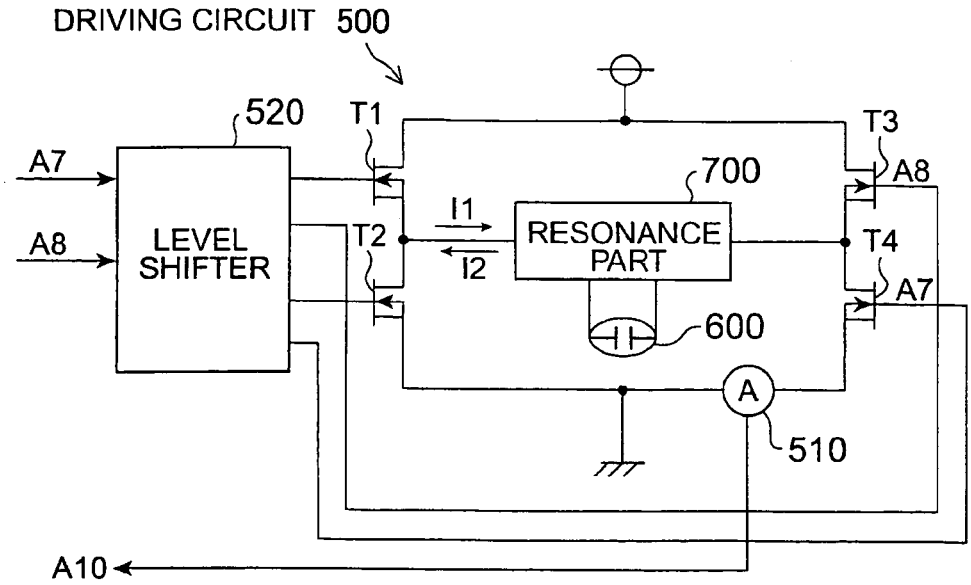
FIG. 16 illustrates a driving circuit 500, a discharge lamp and a resonance part.
Figure 16:
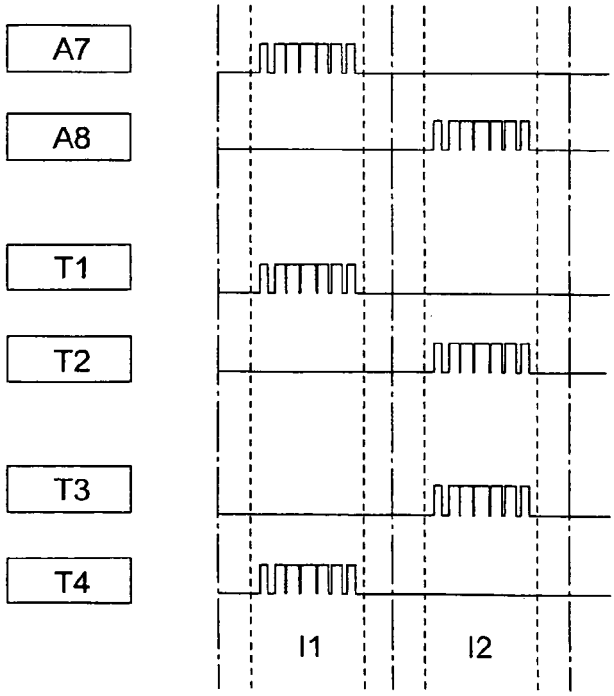

The driving circuit 500 amplifies the two driving signals A7 and A8 to supply the discharge lamp 600 with the amplified signals. FIG. 16 illustrates the driving circuit 500, the discharge lamp 600 and the resonance part 700. The driving circuit 500 comprises a level shifter 520 for amplifying the two driving signals A7 and A8, an H type bridge circuit consisting of four transistors T1 to T4, and the current sensor 510.

The amplified first driving signal A7 is applied to gates of the transistors T1 and T4. The amplified second driving signal A8 is applied to gates of the transistors T2 and T3. Voltages on the transistors T1 to T4 at that time are shown in the timing chart in the lower part of FIG. 16. The first driving signal A7 applied to the resonance part 700 causes the current I1 to flow in the resonance part 700. The second driving signal A8 applied to the resonance part 700 causes a reverse current I2. The current I1 is detected by the current sensor 510 and outputted as the resonance part signal A10. A voltage applied to the resonance part 700 corresponds to the applied voltage signal A9 in FIGS. 9 and 10 since the first driving signal A7 and the second driving signal A8 apply mutually reverse voltages to the resonance part 700. The driving circuit 500 corresponds to the voltage generating circuit in the claimed invention. The waveform generator 100, the PWM controller 200, the AND circuit 300, the polarity converter 400, the driving circuit 500 and the CPU 800 correspond together to the voltage controller in the claimed invention.

Figure 17:
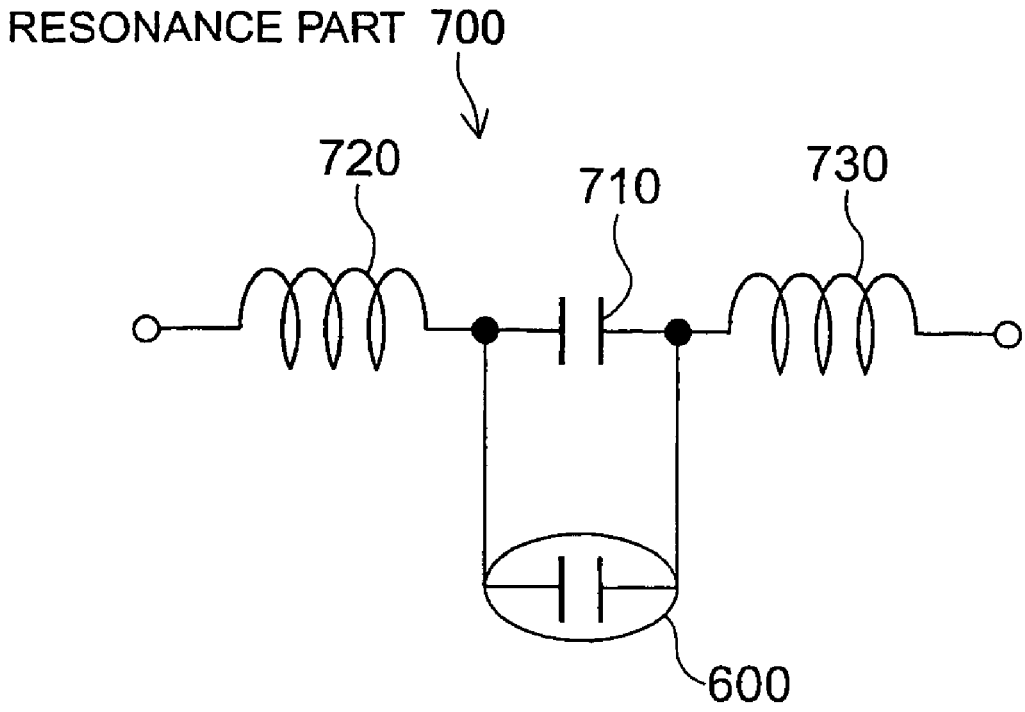
FIG. 17 illustrates the resonance part and the discharge lamp.

FIG. 17 illustrates the resonance part 700 and the discharge lamp 600. The resonance part 700 is a series resonant circuit comprising resonance coils 720 and 730 and a resonance condenser 710. The electric power supplied from the resonance part 700 to the discharge lamp 600 depends on the frequencies of the resonance part voltages V2 and V3 applied to the resonance part 700. The discharge lamp 600 lights with high efficiency when the frequencies of the resonance part voltages V2 and V3 applied to the resonance part 700 are within the resonant frequency range. In the embodiment, it is arranged that the frequencies of the resonance part voltages V2 and V3 reach the resonant frequency range by gradually varying a frequency of the sine wave signal A1 for the purpose of starting lighting of the discharge lamp 600. Especially, the frequency of the sine wave signal A1 is monotonously increased to do so in the embodiment. It is also arranged that the frequencies of the resonance part voltages V2 and V3 be held in the resonant frequency range by adjusting a difference in phase between the sine wave signal A1 and the resonance part signal A10 within a desired small range in order to maintain the desired lighting condition.

As seen from the discharge lamp voltages V2 and V3 in FIGS. 9 and 10, the longer a period where the mask signal A4 is at the H level is, the longer the time for applying voltage to the resonance part 700 becomes. This causes the brightness of the discharge lamp 600 to be increased. That is to say, the mask signal A4 is used for adjusting the brightness of the discharge lamp 600 and the wider the time range of the mask signal A4 at the H level is, the more the brightness of the discharge lamp 600 increases, as mentioned above.

FIG. 9 also shows a resonance part voltage V1 in the case that the hysteresis upper limit value CT and the hysteresis lower limit value CB are equal to VDD/2 (128 in an 8-bits signal), namely, in the case that the mask signal A4 takes the H level all the time. The discharge lamp 600 comes to maximum lighting or the brightest state when the resonance part voltage is equal to V1. Both of the hysteresis upper limit value CT and the hysteresis lower limit value CB may take VDD/2 as a default value.

The CPU 800 in the embodiment has a function of judging the life of the discharge lamp 600, as mentioned-above. Returning to FIG. 8, the lighting judging signal A12 (FIGS. 12 and 13) is inputted to the CPU 800. The CPU 800 judges that the life of the discharge lamp 600 (including the resonance part 700, and it is the same with the following description) is coming to an end when a period necessary for lighting Ton, which is a period from an instruction of lighting the discharge lamp 600 to a reach of the lighting judging signal A12 to 1, is too long. Concrete description will be made hereinafter. An initial period value Tint is recorded in a built-in memory of the liquid crystal projector 10 in shipping. The CPU 800 measures the period necessary for lighting Ton. The CPU 800 judges that the life of the discharge lamp 600 is coming to an end when the period necessary for lighting Ton satisfies the following formula (2), while it judges that the life of the discharge lamp 600 is not coming to an end when the period necessary for lighting Ton satisfies the following formula (3).

$$\mathrm{Tint} \times Kt \leqq \mathrm{Ton} \quad (2)$$

$$\mathrm{Tint} \times Kt > \mathrm{Ton} \quad (3)$$

Kt is a constant in the formulas (2) and (3), but may be a variable.

Further, the CPU 800 judges that the life of the discharge lamp 600 is coming to an end when the resonance part signal A10 (the current flowing in the resonance part 700) increases too much. Concrete description will be made hereinafter. A maximum assurance discharge current value Iint is recorded in a built-in memory of the liquid crystal projector 10 in shipping. The CPU 800 judges that the life of the discharge lamp 600 is coming to an end when the resonance part signal A10 satisfies the following formula (4), while it judges that the life of the discharge lamp 600 is not coming to an end when the resonance part signal A10 satisfies the following formula (5).

$$\mathrm{Iint} \leqq \mathrm{A10} \quad (4)$$

$$\mathrm{Iint} > \mathrm{A10} \quad (5)$$

As described above, the frequency of the sine wave signal A1 is monotonously changed toward the resonance frequency until the discharge lamp 600 reaches the desired lighting condition so as to raise the voltage applied to the discharge lamp 600 to an alternating current high voltage in the embodiment. Flow and detection of the discharge current without applying a usual direct current high voltage allow the discharge lamp 600 to be efficiently lit. Further, applying no direct current high voltage causes reduction in consumption power. Moreover, monotonously changing a frequency allows the discharge lamp 600 to be lit certainly, so that there is no need to apply the direct current high voltage many times. This enables shortening of a period from starting control for lighting the discharge lamp 600 to actual lighting of the discharge lamp 600. In the embodiment, achieved is alternating current lighting, which can absorb a change in structure in the discharge lamp 600, a change of the discharge lamp 600 according to the passage of time and a change in temperature of the discharge lamp 600. This enables stable lighting of the discharge lamp 600. Lighting of the discharge lamp 600 can be immediately controlled even in the case that the discharge lamp 600 is at a high temperature just after the discharge lamp 600 is extinguished, for example. As described above, the alternating current-based lighting of the discharge lamp 600 further elongates the life of the discharge lamp 600.

In the conventional techniques, the CPU 8 should be used for control in order to maintain lighting of the discharge lamp 5. This causes a heavy process load on the CPU 8. In accordance with the present invention, however, the lighting is maintained by adjusting the frequency in the self-control manner even after the discharge lamp 600 is lit, so that the process load on the CPU 800 in monitoring control can be reduced. Further, in the conventional techniques, the lighting cannot follow a change in discharge characteristic based on a change in discharge environment including change in voltage, change in temperature, discharge gap and the like since a voltage with a fixed frequency is usually applied during the stable period after lighting of the discharge lamp. The lighting procedure adaptable to a change in temperature and the like, however, is achieved in the embodiment, so that the discharge lamp 600 can be lit stably. Achieving lighting of the discharge lamp 600 so as to follow a change in environment allows the discharge lamp 600 to be lit efficiently with low consumption power.

In addition, it is possible to judge whether or not the life of the discharge lamp 600 is coming to an end by measuring a period from a point of time at which the frequency generator 110 starts changing the frequency to a point of time at which the discharge lamp becomes the desired lighting condition, or by detecting the induced current in the discharge lamp.

Further, in accordance with the embodiment, it is possible to achieve control of the voltage applied to the discharge lamp 600 on the basis of the frequency by PWM control. The discharge lamp controller 1000 has a logic circuit structure and can be easily formed into an IC. The discharge lamp controller 1000 and the CPU 800 in the embodiment are capable of adjusting the brightness in accordance with a dimmer control value, so that the dimmer control can be easily performed. In the embodiment, the parameter Pci of the induced signal comparator 111 and/or the parameter Pco of the driving signal comparator 112 are changed by the CPU 800 to carry out phase adjustment between the sine wave signal A1 and the resonance part signal A10. This achieves power control by changing an oscillation frequency whereby the light dimmer control can be easily performed.

As seen from the lower part of FIG. 15, a period in which the signal TP is at the H level has a symmetrical shape with respect to the timing in which the sine wave signal A1 takes its maximum value. Similarly, a period in which the signal BT is at the H level has a symmetrical shape with respect to the timing in which the sine wave signal A1 takes its minimum value. Thus, a period in which the mask signal A4 (formed by combining the signal TP and the signal BT) is at the H level has a symmetrical shape with respect to the timing in which the sine wave signal A1 takes a peak value. This can be readily understood by comparing FIGS. 9 and 10. In other words, a mask period of the first PWM signal A3 can be considered to be set so that the first PWM signal A3 would be masked in a time range symmetrical with respect to the timing in which the polarity of the sine wave signal A1 is reversed. That is to say, the liquid crystal projector 10 in the embodiment has high power efficiency in light dimmer control because the first PWM signal A3 is masked to achieve the dimmer control in a period where the discharge lamp 600 do not cause effective lighting for the applied voltage.

C. Variations (1) In the above embodiment, the multiplexer MPX switches signals to be outputted to the operational amplifiers OP1 and OP2 in accordance with whether the lighting judging signal A12 is 1 or 0. The timing for switching, however, is not limited to the above, and various kinds of timing for switching may be selected. Further, the dimmer control value can be automatically varied by the electronic variable resistor VR in the above embodiment. The dimmer control value, however, may be set at a fixed value. Moreover, the electronic variable resistor VR varies the dimmer control value responsive to the frequency adjusting signal A11 in the embodiment, but the invention is not limited to the above, and the dimmer control value may be varied responsive to other signals.

(2) In the above embodiment, the frequency generator 110 is constructed as an analog PLL (phase lock loop) circuit. The present invention, however, is not limited to the above, and the frequency generator 110 may be constructed as a digital PLL circuit, a circuit using a DSP (digital signal processor) or the like.

(3) In the embodiment, the reference wave signal in the claimed invention is realized as a sine wave signal. The reference wave signal, however, may be any signal other than the sine wave signal so long as the signal has a non-rectangle waveform. The reference wave signal may be a triangle wave signal or a sawtooth wave signal, for example. In the case of a sine wave, however, it is possible to reduce a loss in voltage during a period in which little current flows and to improve efficiency in power. This contributes to an advantage that the power efficiency can be improved, and thereby the radiant noise can be reduced. As a result, reduction in number of the countermeasure components can be achieved. Furthermore, the reference wave signal is generated by the counter 120 and the sine wave table 140 in the above embodiment, but it may be generated by means of duty control using a clock signal. In the above embodiment, the comparison wave signal is realized as a sawtooth wave signal, but the comparison wave signal may be any signal other than the sawtooth wave signal as long as the signal is shorter in wavelength than the sine wave signal A1 and has a non-rectangle waveform. The comparison wave signal may be a triangle wave signal, for example.

(4) In the above embodiment, the masking period of the first PWM signal A3 when the hysteresis upper limit value CT and the hysteresis lower limit value CB are used as the dimmer control values is set so that the first PWM signal A3 would be masked in a time range symmetrical with respect to the timing in which the polarity of the discharge lamp voltage is reversed. The mask period, however, is not limited to the above, and any period of the first PWM signal A3 may be masked for performing the dimmer control.

(5) In the above embodiment, the mask signal generator 220 and the AND circuit 300 are constructed so that the first PWM signal A3 would be masked. The signal to be masked, however, is not limited to the above, and the sine wave signal A1 or other signals usable as a reference to determine a voltage to be applied to the discharge lamp may be masked so as to carry out the dimmer control.

(6) In the above embodiment, the mask signal generator 220 and the AND circuit 300 act as the second PWM signal generator in the claimed invention to achieve the dimmer control. They may be omitted so that no dimmer control is performed. In this case, the discharge lamp controller 1000 directly inputs signals including the first PWM signal A3 and the sine wave signal A1 to the polarity converter 400.

(7) In the above embodiment, the PWM control is used for voltage control. The invention, however, is not limited to the above, and the voltage control may be performed with other circuitry.

(8) Although the life of the discharge lamp 600 is judged by the CPU 800 in the above embodiment, the judgment is not necessarily carried out. It is also possible to only perform any one of the two judgments: the judgment of the life by measuring the period necessary for lighting Ton, and the judgment of the life by means of the resonance part signal A10.

(9) In the above embodiment, the CPU 800 adjusts the parameters Pci and Pco after the discharge lamp 600 is lit, thereby changing the phase difference between the sine wave signal A1 and the resonance part signal A10, and variably setting the frequency fsin. The parameters Pci and Pco, however, may be fixed instead.

(10) The resonance part 700 may be omitted. This is applicable in the case where the discharge lamp 600 has a function of amplifying power at a specific frequency, for example.

(11) The resonance part signal A10 may indicate an induced voltage instead of an induced current. That is to say, the circuitry may include a voltage sensor instead of a current sensor. Further, it is possible to provide both of the current sensor and the voltage sensor to obtain the resonance signal A10 as a result of calculation using the induced current and the induced voltage. It is also possible to use an optical sensor to obtain the resonance part signal A10. The sine wave signal A1 may correspond to the current to be applied to the discharge lamp 600 although it corresponds to the voltage to be applied to the discharge lamp 600 (the resonance part 700) in the above embodiment. Moreover, although the judgment whether or not the discharge lamp is in the lighting condition is performed on the basis of the phase difference between the resonance part signal A10 and the sine wave signal A1 in the above embodiment, other methods may be used for judgment instead.

Figure 18:
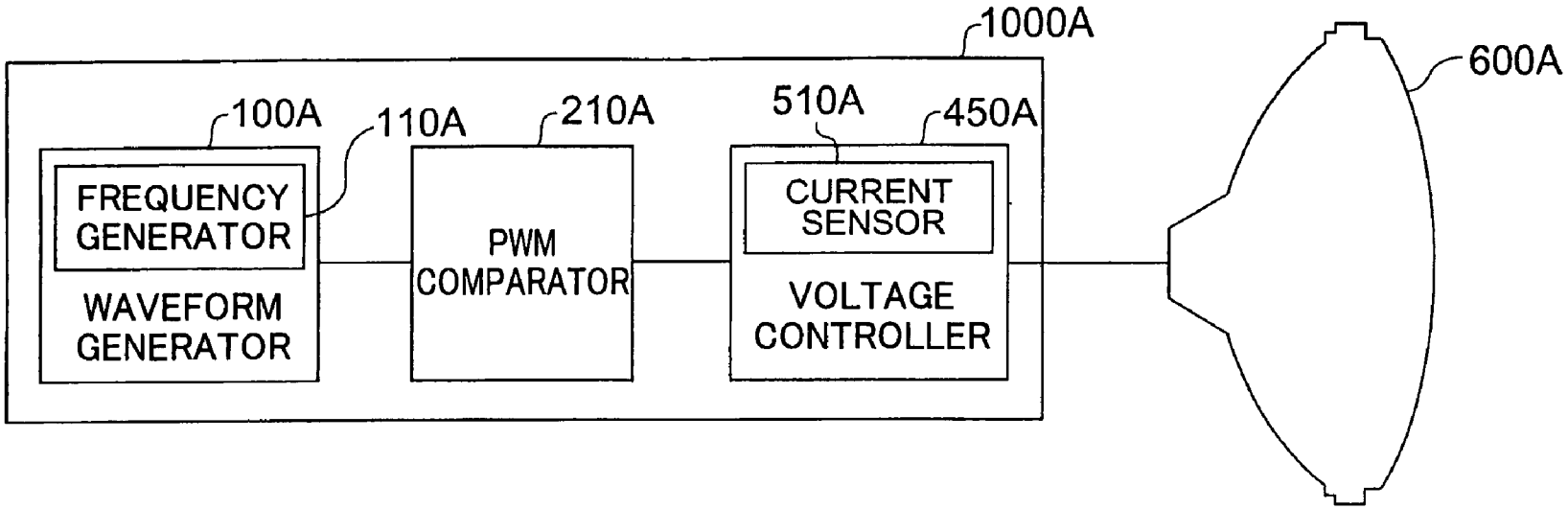
FIG. 18 illustrates a vehicle-mounted illumination apparatus as an example of an illumination apparatus.
Figure 19A:
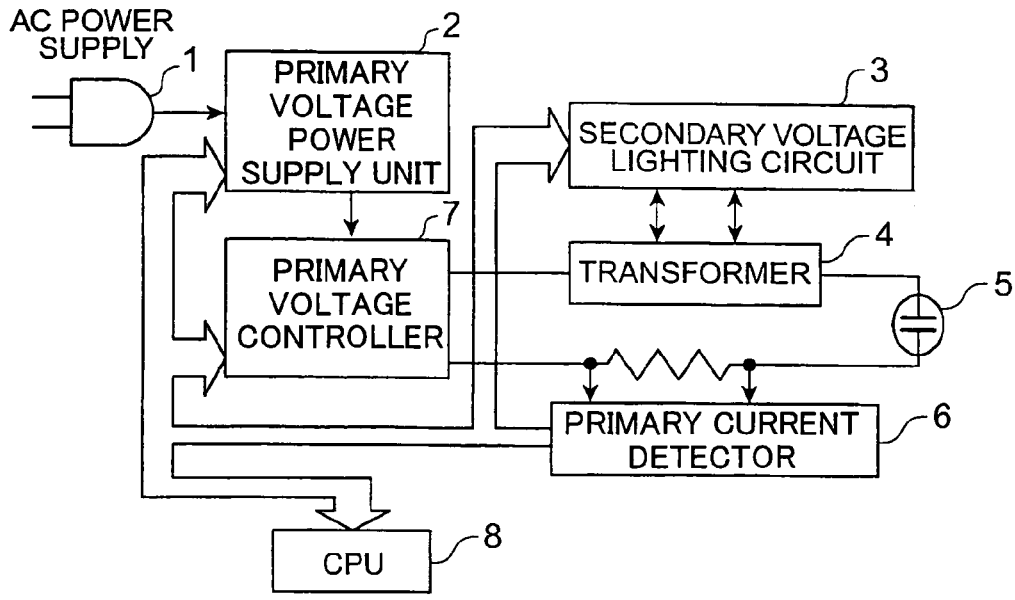
FIGS. 19A and 19B illustrate a technique disclosed in Japanese Patent Application Publication H05-217682.
Figure 19B:
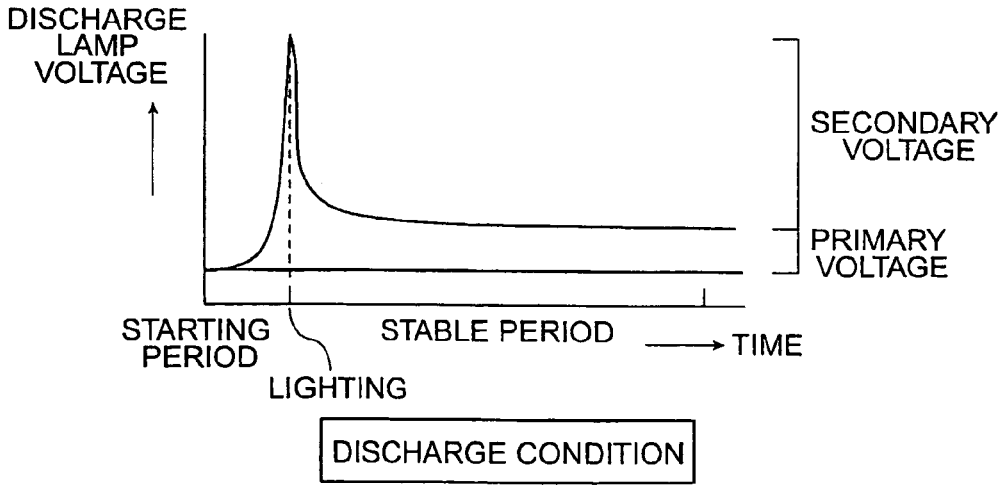

(12) In the above embodiment, the liquid crystal projector 10 is described as an embodiment of a projection type image display device. The projection type image display device, however, is not limited to the above, and it may be a DLP (a registered trademark of Texas Instruments Incorporated in the US) projection type image display device. The invention may also be applicable to an illumination apparatus. FIG. 18 illustrates a vehicle-mounted illumination apparatus as an embodiment of an illumination apparatus. The vehicle-mounted illumination apparatus comprises a headlamp 600A as a discharge lamp and a headlamp controller 1000A. The headlamp controller 1000A comprises a waveform generator 100A, a frequency generator 110A, a PWM comparator 210A, a current sensor 510A and a voltage controller 450A. The waveform generator 100A, the frequency generator 110A, the PWM comparator 210A and the current sensor 510A respectively have functions same as those of the waveform generator 100, the frequency generator 110, the PWM comparator 210 and the current sensor 510, which are described in the above embodiment. The voltage controller 450A has a function same as the functions of the polarity converter 400, the driving circuit 500 and the resonance part 700, which are described in the above embodiment. The headlamp controller 1000A may further comprise a mask signal generator 220, for example, so as to have a structure same as that of the discharge lamp controller 1000 in the above embodiment. The vehicle-mounted illumination apparatus may further comprise a dimmer control value setting unit, a period measuring unit and a judging unit, which have functions same as the functions of the CPU 800. The illumination apparatus is not limited to the vehicle-mounted illumination apparatus but may be used for various kinds of purposes such as a cold cathode tubing, a neon tubing and the like.

The discharge lamp controlling apparatus, the discharge lamp controlling method, the projection type image display device and the illumination apparatus in accordance with the invention have been described above on the basis of the embodiments. The embodiments of the invention are given for easy understanding of the invention and do not limit the invention. It goes without saying that the invention can be modified and improved without deviating from a scope and claims of the invention while the equivalents thereto are included in the invention.

What is claimed is:

1. An apparatus comprising:

a detector for detecting a discharge condition of a discharge lamp;

a frequency changing unit for gradually changing a frequency of a voltage to be applied to the discharge lamp until the discharge condition reaches a predetermined lighting condition; and a voltage controller for controlling the voltage to be applied to the discharge lamp based on the frequency changed by the frequency changing unit; wherein the detector detects an induced voltage or an induced current in the discharge lamp, and the frequency changing unit judges whether the discharge condition is the lighting condition or not in accordance with whether a difference in phase between the voltage or current to be applied to the discharge lamp and the induced voltage or the induced current in the discharge lamp is in a predetermined range or not.

2. An apparatus according to claim 1, wherein the frequency changing unit monotonously increases the frequency of the voltage to be applied to the discharge lamp until the discharge condition reaches the lighting condition.

3. An apparatus according to claim 1, wherein the frequency changing unit variably adjusts the frequency of the voltage to be applied to the discharge lamp responsive to the discharge condition detected by the detector so as to maintain the discharge lamp at the lighting condition even after the discharge condition reaches the lighting condition.

4. An apparatus according to claim 1, wherein the discharge lamp includes a resonance part, and the resonance part includes:

a coil connected in series to the discharge lamp; and an electrostatic capacity connected in parallel to the discharge lamp.

5. An apparatus according to claim 1, wherein the apparatus is an illumination apparatus including the discharge lamp.

6. An apparatus according to claim 1, wherein the apparatus is a projection display apparatus including the discharge lamp, the apparatus further comprising:

a projecting display unit for projecting an image using illumination light from the discharge lamp.

7. An apparatus, comprising:

a detector for detecting a discharge condition of a discharge lamp;

a frequency changing unit for gradually changing a frequency of a voltage to be applied to the discharge lamp until the discharge condition reaches a predetermined lighting condition; and a voltage controller for controlling the voltage to be applied to the discharge lamp based on the frequency changed by the frequency changing unit; wherein the frequency changing unit changes a difference in phase between a voltage or current to be applied to the discharge lamp and an induced voltage or induced current in the discharge lamp in accordance with an operating condition, thereby variably adjusting a frequency of the voltage to be applied to the discharge lamp.

8. An apparatus comprising:

a detector for detecting a discharge condition of a discharge lamp;

a frequency changing unit for gradually changing a frequency of a voltage to be applied to the discharge lamp until the discharge condition reaches a predetermined lighting condition; and a voltage controller for controlling the voltage to be applied to the discharge lamp based on the frequency changed by the frequency changing unit;

a period measuring unit for measuring a period from a point of time when the frequency changing unit starts changing the frequency to a point of time when the discharge condition reaches the lighting condition; and a judging unit for comparing the period with a predetermined value to judge whether or not life of the discharge lamp is coming to an end.

9. An apparatus comprising:

a detector for detecting a discharge condition of a discharge lamp;

a frequency changing unit for gradually changing a frequency of a voltage to be applied to the discharge lamp until the discharge condition reaches a predetermined lighting condition; and a voltage controller for controlling the voltage to be applied to the discharge lamp based on the frequency changed by the frequency changing unit; wherein the detector detects an induced current value in the discharge lamp, and the apparatus further comprises:

a judging unit for comparing the induced current value with a predetermined value to judge whether or not life of the discharge lamp is coming to an end.

10. An apparatus comprising:

a detector for detecting a discharge condition of a discharge lamp:

a frequency changing unit for gradually changing a frequency of a voltage to be applied to the discharge lamp until the discharge condition reaches a predetermined lighting condition; and a voltage controller for controlling the voltage to be applied to the discharge lamp based on the frequency changed by the frequency changing unit; wherein the voltage controller includes:

a waveform generator for generating a reference wave signal having a non-rectangle waveform, and a comparison wave signal which is shorter in wave length than the reference wave signal and which has a non-rectangle waveform, based on the frequency changed by the frequency changing unit; and a first PWM signal generator for comparing the reference wave signal and the comparison wave signal to generate a first PWM signal, and wherein the voltage to be applied to the discharge lamp is controlled based on the first PWM signal.

11. An apparatus according to claim 10, wherein the reference wave signal is a sine wave.

12. An apparatus according to claim 10, wherein the voltage controller further includes:

a dimmer control value setting unit for setting a dimmer control value for controlling brightness of the discharge lamp; and a second PWM signal generator for masking the first PWM signal to generate a second PWM signal based on the dimmer control value, and wherein the voltage to be applied to the discharge lamp is controlled according to the second PWM signal.

13. An apparatus according to claim 12, wherein the second PWM signal generator masks the first PWM signal in a time range symmetrical with respect to timing when polarity of the reference wave signal is reversed.

14. An apparatus comprising:

a detector for detecting a discharge condition of a discharge lamp;

a frequency changing unit for gradually changing a frequency of a voltage to be applied to the discharge lame until the discharge condition reaches a predetermined lighting condition; and a voltage controller for controlling the voltage to be applied to the discharge lamp based on the frequency changed by the frequency changing unit; wherein the voltage controller includes:

a signal generator for generating an original driving signal having a frequency which is changed by the frequency changing unit;

a dimmer control value setting unit for setting a dimmer control value for controlling brightness of the discharge lamp;

a driving signal generator for masking the original driving signal based on the dimmer control value to generate a driving signal; and a voltage generating circuit for generating the voltage to be 5 applied to the discharge lamp responsive to the driving signal.

15. A method of controlling a discharge lamp, comprising:

detecting a discharge condition of the discharge lamp;

gradually changing a frequency of a voltage to be applied to the discharge lamp until the discharge condition reaches a predetermined lighting condition; and controlling the voltage to be applied to the discharge lamp based on the changed frequency; wherein the detecting includes detecting an induced voltage or an induced current in the discharge lamp, and the change in frequency is determined by judging whether the discharge condition is the lighting condition or not in accordance with whether a difference in phase between the voltage or current to be applied to the discharge lamp and the induced voltage or the induced current in the discharge lamp is in a predetermined range or not.

* * * * *